United States Patent [19]

VanOmmeren

[11] Patent Number: 4,887,857

[45] Date of Patent: Dec. 19, 1989

[54] METHOD AND SYSTEM FOR FILLING CRYOGENIC LIQUID CONTAINERS

[75] Inventor: James VanOmmeren, Werley's Corner, Pa.

[73] Assignee: Air Products and Chemicals, Inc., Allentown, Pa.

[21] Appl. No.: 293,732

[22] Filed: Jan. 5, 1989

Related U.S. Application Data

[63] Continuation-in-part of Ser. No. 888,655, Jul. 22, 1986.

[51] Int. Cl.[4] ..... F17C 13/00

[52] U.S. Cl. ..... 141/1; 141/5; 141/11; 141/39; 141/47; 141/51; 141/82; 141/83; 62/49.2; 62/55.5

[58] Field of Search ..... 62/49–55; 141/1, 4–7, 11, 69, 82, 39, 47–51, 98, 83

[56] References Cited

U.S. PATENT DOCUMENTS

| | | | |
|---|---|---|---|
| 3,802,471 | 4/1974 | Wickenhauser | 141/39 |
| 3,863,669 | 2/1975 | Ishida et al. | 137/386 |
| 3,938,347 | 2/1976 | Riedel et al. | 62/55 |
| 4,276,749 | 7/1981 | Crowley | 62/51 |
| 4,475,348 | 10/1984 | Remes | 62/55 |
| 4,487,025 | 12/1984 | Hamid | 62/54 |
| 4,570,819 | 2/1986 | Perkins et al. | 220/374 |

OTHER PUBLICATIONS

F. P. Incropera et al., *Fundamentals of Heat Transfer* John Wiley & Sons, New York, N.Y., 1981.

"A Study of Liquid Cylinder Filling Techniques"by R. C. Woerner, Air Reduction Co., undated.

"Filling Procedure for Cryogenic Liquid Cylinders", Air Products and Chemicals Operations Manual, May 1977, vol. 1, ec. 9.2, p. 1.

"Startup of Centrifugal Pumps in Flashing or Cryogenic Liquid Service," Rattan and Pathak, *Chemical Engineering,* 4/1/85, p. 95.

"The Solution to High Liquid Cylinder Filling Losses," Minnesota Valley Engineering Inc., Product Literature, Undated.

MVE, "Multiple Gas Lo—Loss Filling Manifold," Minnesota Valley Engineering, Product Literature.

"A Cryogenic Systems Approach to Industrial Gas Distributors Liquid Cylinder Filling Losses," Minnesota Valley Engineering, Inc., Product Literature.

*Primary Examiner*—Ernest G. Cusick

*Attorney, Agent, or Firm*—James C. Simmons; William F. Marsh

[57] ABSTRACT

Substance loss is minimized in a station for loading a container with cryogenic substance stored in a tank. A throttle vent valve is provided at the outlet vent of a container being loaded for controlling the differential pressure between the storage tank and the container. The throttle vent valve is adjusted to maintain the differential pressure at a value equal to the optimum differential pressure for minimizing substance loss. The optimum differential pressure is selected by determining the filling loss for a plurality of values of differential pressure and selecting the differential pressure which produces the minimum filling loss.

9 Claims, 9 Drawing Sheets

340
342
344
346
348
% LOSS
70
60
50
40
30
20
10
0
10
20
30
40
50
CYLINDER PRESSURE (psig)

METHOD AND SYSTEM FOR FILLING CRYOGENIC LIQUID CONTAINERS

This application is a continuation-in-part of co-pending application U.S. Ser. No. 888,655, filed 7/22/86.

A portion of this patent document contains material which is subject to copyright protection. The owner has no objection to the facsimile reproduction by anyone of the patent document or patent disclosure as it appears in the Patent and trademark Office patent file or records, but otherwise reserves all rights whatsoever.

BACKGROUND OF THE INVENTION

1. Field of the Invention

This invention relates to the field of loading liquefied gases into containers.

2. Description of Related Art

Typically a filling station has a large storage tank in which a cryogenic substance is stored in liquid form. Portable cylinders, which are superinsulated to maintain the cryogenic substance in its liquid form, must be periodically refilled from these filling stations and transported to a place of use.

During the transfer of liquefied gases from the storage tank to the portable cylinder, a portion of the product gas is wasted. These filling losses, depending on the circumstances, may be a significant percentage of the product gas.

It is known to transfer cryogenic substances from a storage tank to a liquid cylinder using pressurized transfer filling and centrifugal pump filling. In pressurized transfer filling the pressure head within the storage tank is used to force substance through pipes into a cylinder. In centrifugal pump filling, a centrifugal pump is disposed in line between the storage tank and the liquid cylinder for transferring substance.

The cylinder being filled includes two connections associated with filling, an inlet port and an outlet vent. Substance is loaded into the cylinder through the inlet port while the outlet vent is left open, allowing any liquefied gas which returns to a gaseous form to vent to the atmosphere. As substance flows through a filling station the substance absorbs heat causing the substance to change state into gas and causing high venting losses due to excessive flashing from the pressure letdown between storage tank and cylinder pressure as a substance enters the cylinder.

The conventional liquid cylinder filling technique fills the cylinder with the vent valve completely open, incurring high venting losses due to excessive flashing of the cryogenic entering the cylinder. Fill line length, diameter, restrictions, and insulation potential contribute to the overall filling loss. Many liquid cylinders are overfilled due to operator error. This can present a serious safety hazard in those fill plants where the cylinder vents into the enclosed fill building. This liquid fill venting mode also causes the filling loss to drastically increase and results in a cylinder which is filled beyond the DOT fill density limit, requiring further venting to achieve the shipping limit.

A number of prior systems have attempted to deal with these large filling losses. These systems include recirculating systems to prevent loss of flashed vapor, top filling the cylinder with pumps and pump aided transfer systems. None of these have been entirely satisfactory.

The recirculating systems have recirculated the flashed vapor generated when the liquid from the tank has entered the cylinder. Recirculating the flashed vapor back to the tank can result in a no loss system. However, there is a serious risk of contamination of the tank if a contaminated liquid cylinder has been filled. Also the heat absorbed by the recirculated vapor is added to the storage tank, an undesirable event. Further, a sophisticated operator is required to run this system.

Top filling with a pump generally has operated only under ideal conditions in which the plumbing between tank and cylinder is precooled and the liquid cylinder is cold. Under typical conditions the cylinder must be blown down periodically to avoid losing pump prime or damaging the seals. Further, the operation takes 10 to 12 minutes on average and requires a sophisticated operator to deal with pump problems and maintenance.

U.S. Pat. No. 4,475,348 discloses use of an automatic throttling valve to vent the cylinder being filled whenever the pressure in the cylinder reaches approximately 10 PSI less than the pressure in the storage tank regardless of filling station configuration or substance. This method decreases filling losses to some degree but its effectiveness varies with station configuration and substance.

It is known that during centrifugal pump transfer of substance from a storage tank to a cylinder, centrifugal pumps are subject to cavitation. Cavitation is caused when the cryogenic substance absorbs thermal energy causing the substance to vaporize in the pump inlet and bubbles of the vapor to be carried to the impeller of the pump. The pump rotor then spins more rapidly in the gas bubble since the gas offers much less resistance than the liquid. This rapid spinning causes friction and heat which warms the gas further causing further vaporization. Unless the motor is stopped when this occurs, the pump motor could burn out or the casing or rotor of the motor could break due to internal friction. If the substance being loaded is liquid oxygen, there is a high potential for a safety hazard.

Rattan in "Cryogenic Liquid Service", *Chemical Engineering*, Apr. 1, 1985, page 95 discloses bleeding a small liquid stream through a hole in a pump to keep the pump cool to deal with this problem. However, in very hot areas, a large amount of substance must be wasted by this method. Another method disclosed in this same article, is bringing the pressure within a system up to a level that prevents flashing.

Another danger present when liquid cylinders are loaded with a cryogenic substance is that if the cylinder is overfilled, liquefied gas product is discharged from the outlet vent of the cylinder. It was a common practice to continue filling a cylinder until liquefied product was discharged from the outlet vent as a way of determining when the cylinder was full. In addition to wasting product this can be dangerous since the liquefied gas may injure an operator by cryogenic burns or asphyxiation or cause an explosion or a fire.

SUMMARY OF THE INVENTION

The present invention is an optimized, integral, and automated liquid filling system capable of performing both pressure transfers and pumped transfers with minimal filling losses.

The system includes a programmable controller which calculates the optimum filling differential pressure from the system input parameters, recalculates the optimum differential pressure during fill and maintains that varying optimum differential pressure throughout the filling cycle by actuating a control valve in the vent line.

The pumped transfer system will determine the point of pump cooldown, automatically start the pump motor, and sense for pump cavitation throughout the fill. A cavitation signal will automatically stop the pump motor, provide for more cooldown time, and restart the motor.

The present invention also provides a completely automated filling system with backup shutoff devices, equipment monitoring instruments, optimized control logic, and output light and alarm indications. This automation performance eliminates operator error and liquid full venting, improves process safety, and yields DOT regulation filled liquid cylinders.

A major advantage of the present invention is improved operating and shipping safety due to (a) elimination of liquid full venting, reducing the asphyxiation hazard for $N_2$/Ar and the fire hazard for $O_2$ if venting into the fill building;

(b) automatic shutdown of the pump under cavitation conditions, reducing oxygen pump fire concerns; and (c) significant reduction in the number of overfull or liquid full cylinders, decreasing the potential for venting liquid through the pressure safety valve during shipping and storage.

Figure 1:
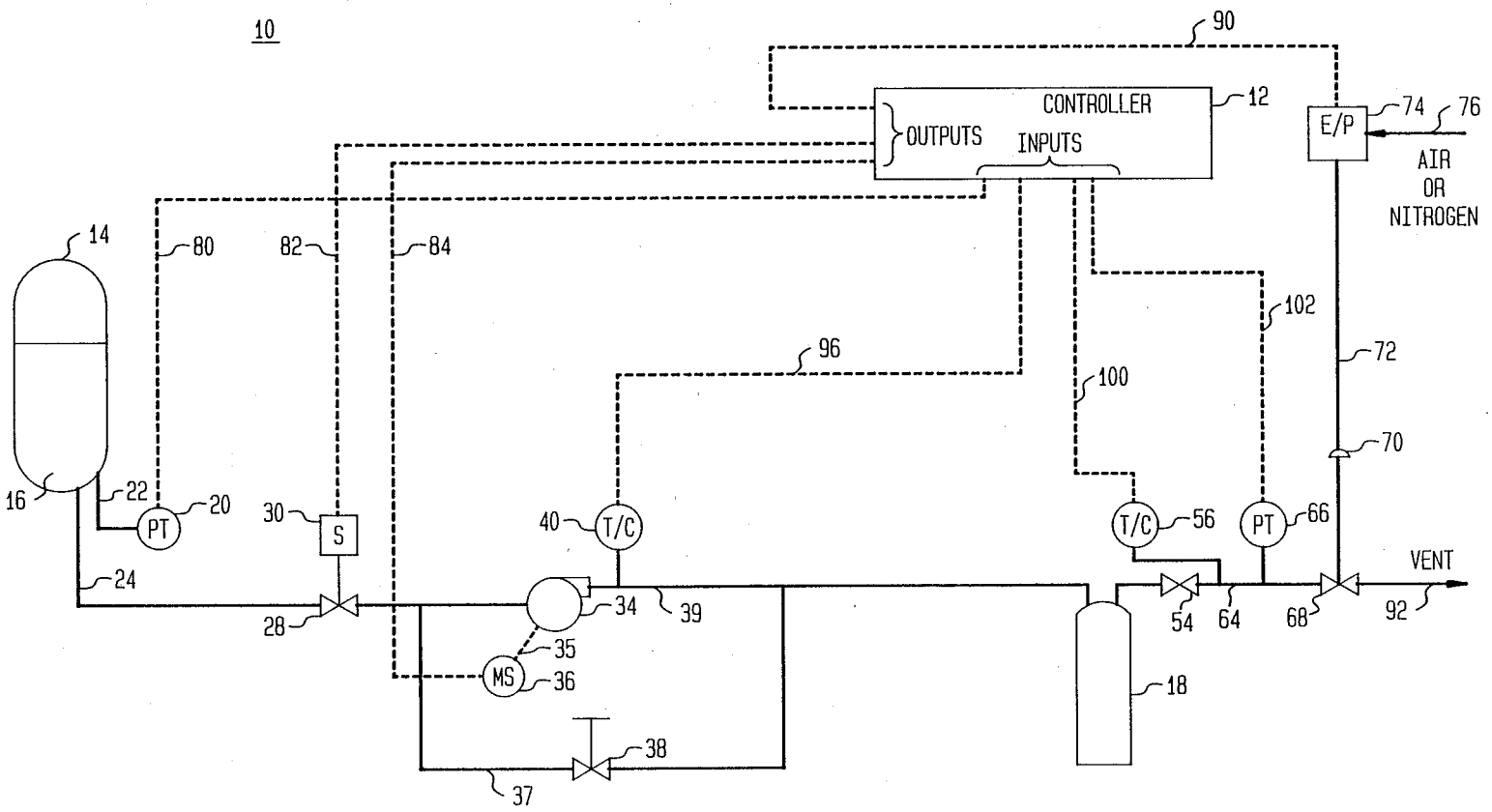
FIG. 1 shows a diagram of the system of the present invention.

DETAILED DESCRIPTION OF THE INVENTION simplified diagram of automated pressure/pump transfer liquid cylinder fill station 10 under control of a controller 12 of the present invention. Fill station 10 loads cryogenic substance 16 such as liquid oxygen, liquid nitrogen, liquid argon or other liquefied gases from storage tank 14 through pipe 24 and fail/close solenoid controlled valve 28 into liquid cylinder or container 18 under the control of a controller 12. The pressure of tank 14 is transmitted to controller 12 by pressure transducer 20 and the pressure of cylinder 18 is transmitted to controller 12 by pressure transducer 66 permitting controller 12 to determine the differential pressure between tank 14 and cylinder 18. Substance 16 may be transferred from storage tank 14 to cylinder 18 either by pressure transfer using the pressure head within tank 14 to move substance 16 ("pressure transfer") or by centrifugal pump transfer using pump 34 ("pump transfer").

Variable throttle vent valve 68, controlled by actuator 70, is provided in system 10 to control the back pressure within cylinder 18 and thereby to optimize the differential pressure between tank 14 and cylinder 18 for station 10 during pressure transfer of substance 16. The differential pressure is optimized for a fill station 10 to minimize the filling loss of substance 16 during the loading operation.

The optimum differential pressure for different fill stations 10 varies depending on the type of substance 16 and parameters such as the pipe length between tank 14 and cylinder 18, the diameter and the thermoconductivity of the material of construction of the pipes between tank 16 and cylinder 18, and the insulation on the pipes. This optimum differential pressure may change during the filling operation in response to changes in the system variables. A method for calculating the optimum differential pressure for a selected fill station will later be described.

When the initial optimum differential pressure for system 10 is calculated, it is stored as a set value in controller 12. Controller 12 then controls the pressure within cylinder 18 during the fill operation by reading pressure transducers 20,66 and adjusting variable throttle vent valve 68 in accordance with the tank pressure to cause the differential pressure of system 10 between tank 14 and cylinder 18 to be substantially equal to the stored set value of optimum differential pressure. Although the differential pressure between tank 14 and cylinder 18 is chosen as the value to be optimized and monitored in station 10, differential pressure between substance 16 being loaded and cylinder 18 may be optimized and monitored for points upstream of cylinder 18 other than tank 14. System variables are monitored and the optimum differential pressure iteratively recalculated during the filling process.

In addition to the optimum differential pressure, controller 12 also controls the flow of substance 16 from tank 14 to terminate the flow in response to an overfill error condition and controls actuation of pump 34 to prevent cavitation. In an error condition, either during pump transfer or pressure transfer of substance 16, cylinder 18 may be overfilled causing liquefied substance 16 to exit cylinder 18 through outlet vent 54 and vent pipes 64,92. The presence of liquefied substance 16 in pipe 64 is detected by thermocouple 56 which is disposed in pipe 64 substantially close to outlet vent 54.

Thermocouple 56 produces a signal at its output proportional to temperature. The output of thermocouple 56 is applied by way of line 100 to controller 12. When controller 12 determines that liquefied substance 16 is present within pipe 64 causing the temperature of pipe 64 to fall below a predetermined low level, controller 12 terminates the supply of substance 16 to cylinder 18. The predetermined low level of temperature which causes controller 12 to terminate the supply of substance 16 is substantially equal to the temperature of liquefied substance 16 within tank 14 calculated at cylinder 18 fill pressure.

Controller 12 terminates the supply of substance 16 by applying a signal by way of line 82 to solenoid 30 which causes solenoid controlled valve 28 to close. When solenoid control valve 28 closes, substance 16 is prevented from passing through pipe 24 to cylinder 18. Thus system 10 controls the supply of substance 16 to cylinder 18 in accordance with the temperature detected in vent pipe 64 substantially near outlet vent 54 of cylinder 18.

During pump transfer of substance 16 to cylinder 18, controller 12 of station 10 controls pump 34 to prevent cavitation of pump 34. When a pump transfer fill operation using pump transfer begins, valve 28 is opened without activating pump 34 permitting substance 16 to flow through pipe 24 to pump 34 thereby cooling pump 34. Valve 38 is closed during pump transfer to prevent substance 16 from travelling through pipe 37 and bypassing pump 34.

Thermocouple 40, disposed in pipe 39 substantially near pump 34, detects the presence of liquefied substance 16 within pipe 39 and thereby the temperature of pipe 39 and of pump 34 and produces a signal related to the temperature of pump 34. Pipe 39 is preferably provided with a fitting (not shown) having a thermal well disposed within one foot of pump 34. Thermocouple 40 may thus be positioned within the well to detect the presence of substance 16 at the outlet of pump 34 while not being subjected to the force of liquefied substance 16 being impelled from pump 34.

Pump 34 is a small (approximately five horsepower) pump. Because the mass of pump 34 is small, the presence of liquefied substance 16 in pipe 39 indicates that pipe 24 and pump 34 are sufficiently cool to prevent cavitation since substance 16 must travel through pipe 24 and pump 34 to reach pipe 39. The signal produced by thermocouple 40 is applied to controller 12 by way of line 96.

When controller 12 determines that pump 34 is sufficiently cool to prevent cavitation, controller 12 activates pump motor 36 by way of line 84. Pump motor 36 is coupled to pump 34 by coupling 35 and drives pump 34 causing liquefied substance 16 to be pumped from tank 14 to cylinder 18. Thus the transfer of liquefied substance 16 by pump 34 begins after pump 34 is cooled to approximately the temperature of substance 16 thereby preventing the formation of gas bubbles within pump 34 during the pumping operation which may cause cavitation of pump 34.

Figure 2:
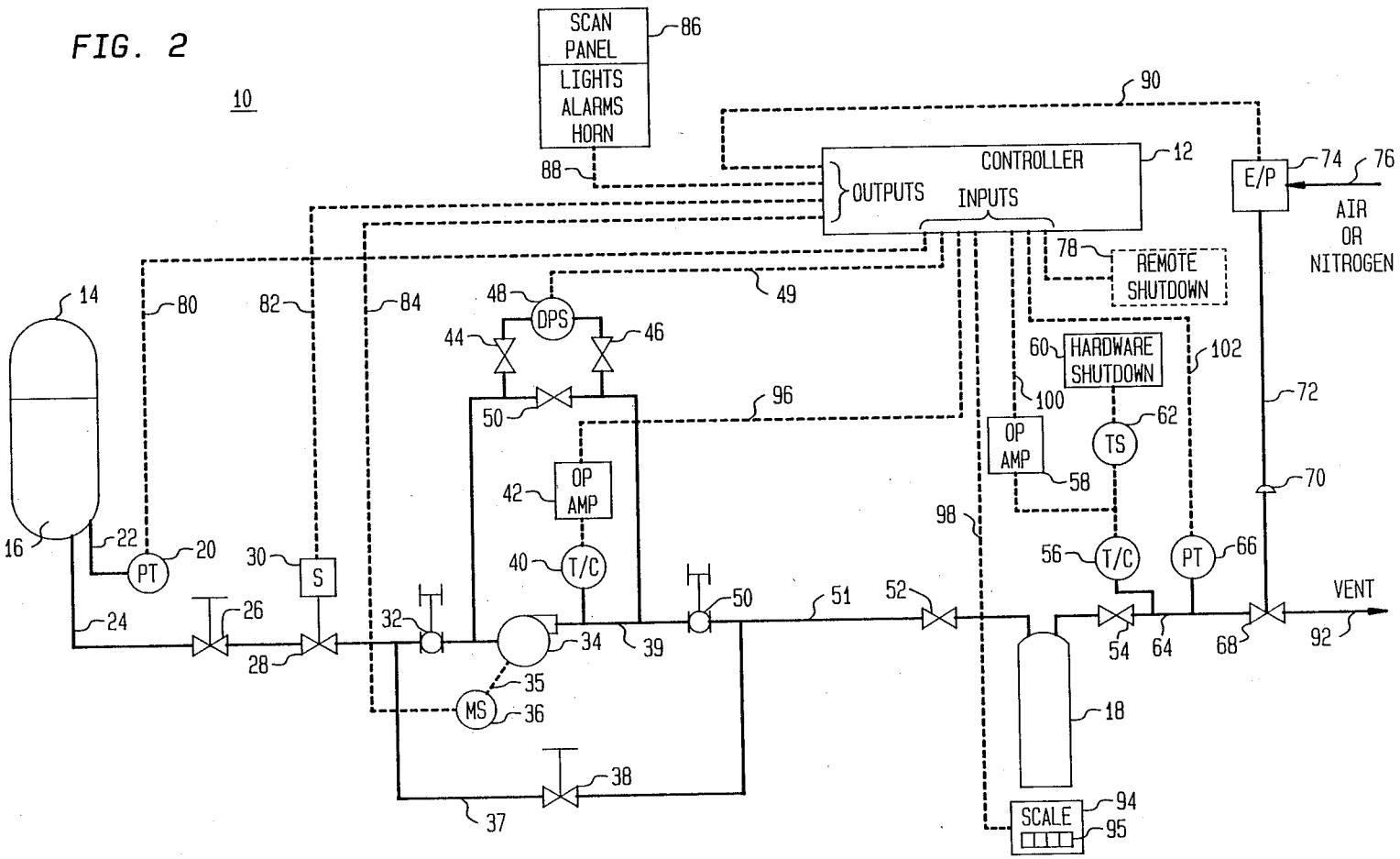
FIG. 2 shows a more detailed diagram of the system of FIG. 1.

Referring now to FIG. 2, a more detailed representation of fill station 10 is shown. In fill station 10 cylinder 18 is positioned on scale 94 during the liquid loading operation. Scale 94 produces an output signal representative of the weight of substance 16 within cylinder 18. The output of scale 94 is monitored by controller 12 by way of input line 98. Controller 12 may be a conventional microprocessor or programmable controller. The control code of Appendix C is used to monitor and adjust the parameters of fill station 10 during filling.

Controller 12 is programmed to determine when the desired weight of liquefied substance 16 has been transferred to cylinder 18 from tank 14. In response to a determination by controller 12 that cylinder 18 contains the desired weight of substance 16, controller 12 terminates the supply of substance from storage tank 14 by controlling solenoid 30 and thereby valve 28 by way of output line 82 as previously described.

Thus fail/close solenoid controlled valve 28 may be closed by controller 12 in response to the occurrence of either of two events. First, when cylinder 18 contains a predetermined amount of substance 16 as indicated by scale 94, controller 12 closes valve 28. Secondly, as a backup method, if cylinder 18 overfills, thus causing the presence of liquefied substance 16 in pipe 64, thermocouple 56 detects a drop in process temperature at output pipe 64 causing controller 12 to close valve 28.

Station 10 also includes two shutdowns: remote shutdown 78 and hardware shutdown 60. An operator may use remote shutdown 78 to indicate to controller 12 that a filling operation on station 10 should be terminated at any time regardless of the internal substance temperature of pump 34 or vent pipe 64. Additionally, as a further safety precaution, hardware shutdown 60 may terminate operation of station 10 automatically in response to the temperature of pipe 64 and independently of controller 12.

Hardware shutdown 60 monitors thermocouple 56 through temperature switch 62 and closes valve 28 and stops pump 34 in response to a backup set point independently of controller 12. Hardware shutdown 60 thus serves as a backup for controller 12 during an overfill error if controller 12 is out of order permitting station 10 to terminate the supply of substance 16 during controller 12 failure.

Figure 3:
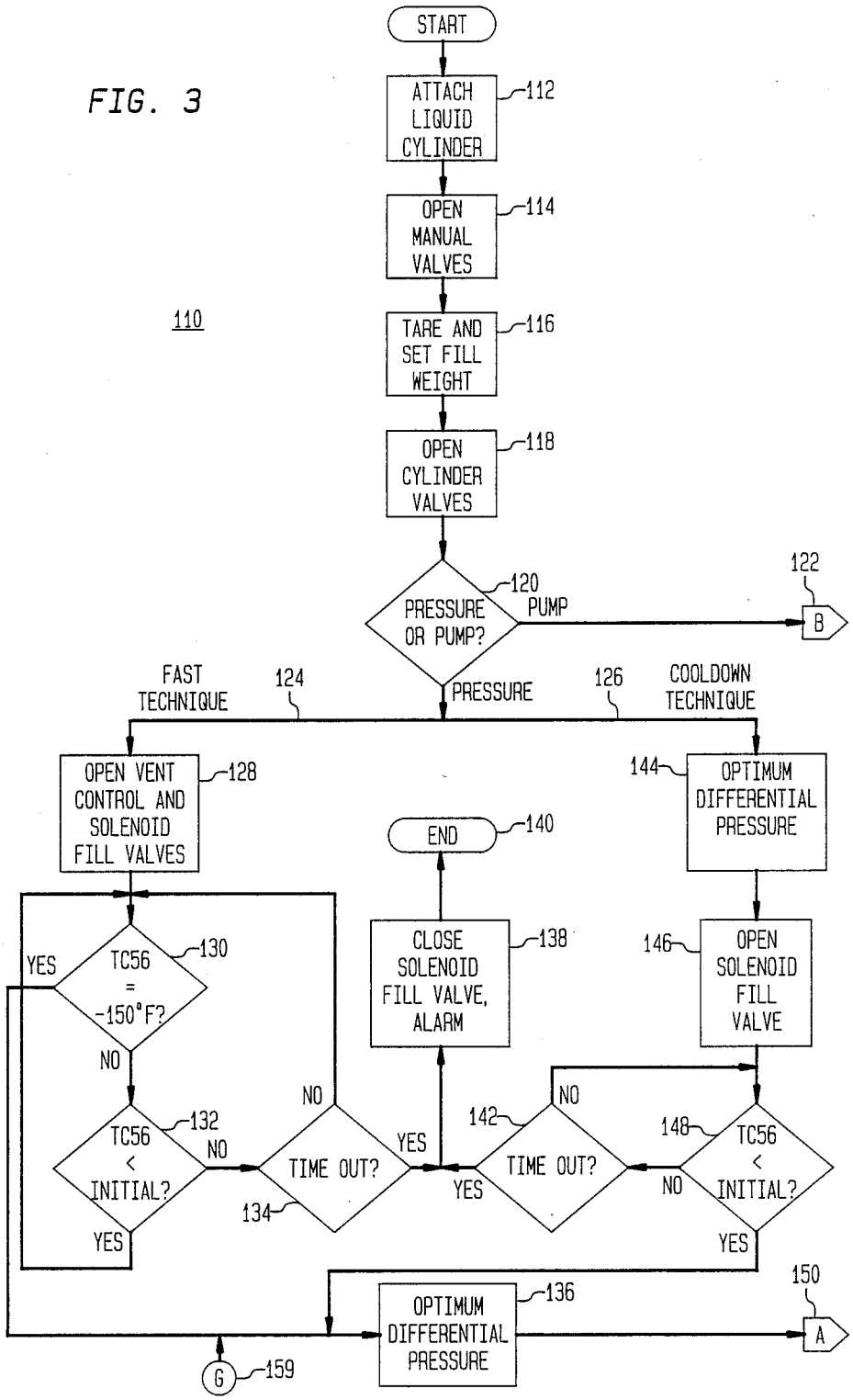
FIG. 3 shows a flow chart representation of a routine for controlling the operations of the system of FIG. 2.

Referring now to FIG. 3, flow chart 110 is shown. Flow chart 110 is a representation of the operations programmed and stored within controller 12 for controlling the operation of fill station 10. The first step in the filling operation is attaching liquid cylinder 18 as shown in block 112. Cylinder 18 includes inlet port 52 and outlet vent 54. Inlet port 52 is coupled to line 51 for receiving substance 16 from storage tank 14. Outlet vent 54 of cylinder 18 is coupled to pipe 64 for venting of substance 16 gasified during filling of cylinder 18.

During the filling process, as liquid substance 16 enters cylinder 18, some liquefied substance 16 vaporizes due to heat input and pressure letdown. The gaseous substance must be vented. In conventional filling operations outlet vent 54 was left open to the atmosphere to permit this flashed vapor to escape. Additionally, if cylinder 18 is overfilled liquefied substance 16 overflows through vent 54. In station 10, however, temperature measurement, pressure measurement and variable back pressure are provided by coupling vent 54 to thermocouple 56, pressure transducer 66 and variable throttle valve 68 respectively on output line 64.

Several manual valves are then opened as shown in block 114. These valves include optional manual valve 26 in line 24 which must be opened if provided within system 10 to allow substance 16 to flow from tank 14. If centrifugal pump 34 is to be used to transfer substance 16 to cylinder 18 ball valves 32,50 must be opened and valve 38 must be closed to permit substance to flow through pump 34 and not bypass pump 34 through pipe 37. If the pressure transfer method is used to fill cylinder 18 then valve 38 must be opened and ball valves 32,50 closed to allow substance 16 to flow around pump 34 by passing through pipe 37.

When cylinder 18 is connected and the required manual valves are open, scale 94 is zeroed and the fill weight is set as described in block 116. The TARE, or zeroing, operation is performed to cause the weight of the cylinder to be ignored by scale 94. For example, if 280 pounds of liquid nitrogen are to be loaded into cylinder 18, then after empty cylinder 18 is on the scale and the scale is zeroed when the scale reads 280 pounds it can be determined that there are 280 pounds of nitrogen in the cylinder.

To cause controller 12 to terminate the supply of substance 16 when 280 pounds of nitrogen have been loaded into cylinder 18, a fill weight of 280 pounds would be entered on dial 95 of scale 94. A relay (not shown) within scale 94 is closed when the weight of substance 16 within cylinder 18 reaches the set point of dial 95. The closing of the relay within scale 94 is detected by controller 12 by way of input line 98.

Cylinder valves 52,54 are then opened as shown in block 118 and a determination is made in decision 120 whether substance loading is to be performed by pressure transfer or pump transfer. If substance loading is to be performed by pressure transfer, two techniques may be followed: a fast technique (path 124) and a cooldown technique (path 126). During pressure transfer, the pressure within tank 14 is used to force substance 16 into cylinder 18. Typical values for the pressure in tank 14 are 50 psi to 150 psi.

If the fast technique of pressure transfer is used, path 124 is followed and variable throttle vent valve 68 and solenoid controlled fill valve 28 are fully opened as described in block 128. This permits substance 16 to flow through pipes 24,39,51 and inlet port 52 to cylinder 18 and to cool cylinder 18 with substantially little back pressure causing the coldest substance 16 to contact the internal surface of cylinder 18. A determination is made at decision 130 whether the temperature of thermocouple 56 is approximately −150° F. which indicates that cylinder 18 is sufficiently cold to further minimize product loss. The temperature of −150° F. is empirically determined and may vary for other product gases.

Thermocouple 56 produces a signal proportional to the temperature in pipe 64 substantially close to outlet valve 54 of cylinder 18. The signal produced by thermocouple 56 is amplified by operational amplifier 58 and applied to controller 12 by way of input line 100 of controller 12. If the temperature of thermocouple 56 is not substantially equal to the temperature of liquefied substance 16, as calculated at cylinder 18 filling pressure, a determination is made at decision 132 whether the temperature of thermocouple 56 is less than the initial temperature before the loading process began. If the temperature of cylinder 18 does not drop below the initial value within a period of time after valve 28 is open an error condition is indicated because if substance 16 is flowing into cylinder 18 as it should cylinder 18 must cool down.

If the temperature of thermocouple 56 is not less than the initial temperature, a timeout routine is executed as shown at decision 134. The timeout decision of 134 is intended to indicate that the execution of the program of controller 112 loops through decisions 130,132,134 for a predetermined period of time waiting for thermocouple 56 to indicate a drop in temperature below the initial value. If the drop in temperature does not occur before this timeout period is over, solenoid valve 28 is closed and an alarm on scan panel 86 is sounded as indicated in block 138 and execution ends at terminal 140.

Once the temperature of thermocouple 56 has fallen below the initial value as determined by decision 132, execution loops through decisions 130,132 until the temperature of thermocouple 56 has reached −150° F. indicating that cylinder 18 has cooled down sufficiently. As shown in block 136, controller 12 applies a signal by way of output line 90 to voltage-to-pneumatic transducer 74 to adjust the pressure of cylinder 18 and optimize the differential pressure of system 10. Voltage to pneumatic transducer 74 receives input instrument air or nitrogen of a predetermined pressure from line 76 and applies a controlled pressure by line 72 to actuator 70. Controller 12 may include digital to analog converters for producing analog signals such as the signal applied to actuator 70.

Actuator 70 causes variable throttle vent valve 68 to close in block 136 until the required pressure in cylinder 18 is produced in accordance with pressure readings of pipe 64 by pressure transducer 66 to achieve optimum differential pressure. Valve 68 may be a conventional throttle valve such as the cryogenic 316SS Globe control valve of the V1S series, manufactured by Jamesbury, with one R2A pneumatic actuator set for fail open on instrument air loss. A typical valve body size is three-quarters of an inch but the valve body size may range from approximately one-half inch to one and one-quarter inch, depending on the type of fill station.

Controller 12 monitors the pressure within tank 14 by reading the output of pressure transducer 20. Pressure transducer 20 is coupled to tank 14 by pipe 22 which opens onto the interior of tank 14. Thus controller 12 may determine the differential pressure between tank 14, including liquefied substance 16 head pressure within tank 14 and cylinder 18 by comparing the outputs of pressure transducers 20,66. The determined value of differential pressure is compared with the stored optimum set value of differential pressure and the pressure of cylinder 18 is adjusted accordingly by adjusting throttle valve 68. The optimum differential pressure is calculated and set in block 136 as set forth in Appendices A,B.

If the cooldown technique of pressure transfer is used rather than the fast technique as previously described, execution follows path 126 to block 144 in which the optimum differential pressure is set immediately rather than after cylinder 18 cools down as described for the fast technique of path 124. The technique of path 126 may be used if cylinder 18 is initially in a precooled condition, allowing filling of substance 16 to occur immediately at the optimum differential pressure. Solenoid controlled fill valve 28 is opened by way of output line 82 as shown in block 146 and thermocouple 56 is compared with the initial temperature in block decision 148 to determine whether cylinder 18 is beginning to cool down indicating that substance 16 is flowing into cylinder 18 as previously described.

If cylinder 18 does not begin cooling within a period of time determined by the timeout of decision 142, as previously described for the timeout of decision 134, then there may be a leak of substance somewhere between tank 14 and cylinder 18 and solenoid valve 28 is closed and an alarm of scan panel 86 is sounded as shown in block 138 as previously described. Whether pressure transfer proceeds by the cooldown technique or the fast technique, execution proceeds to off page connector 150 with the optimum differential pressure already set by adjusting valve 68.

Figure 4:
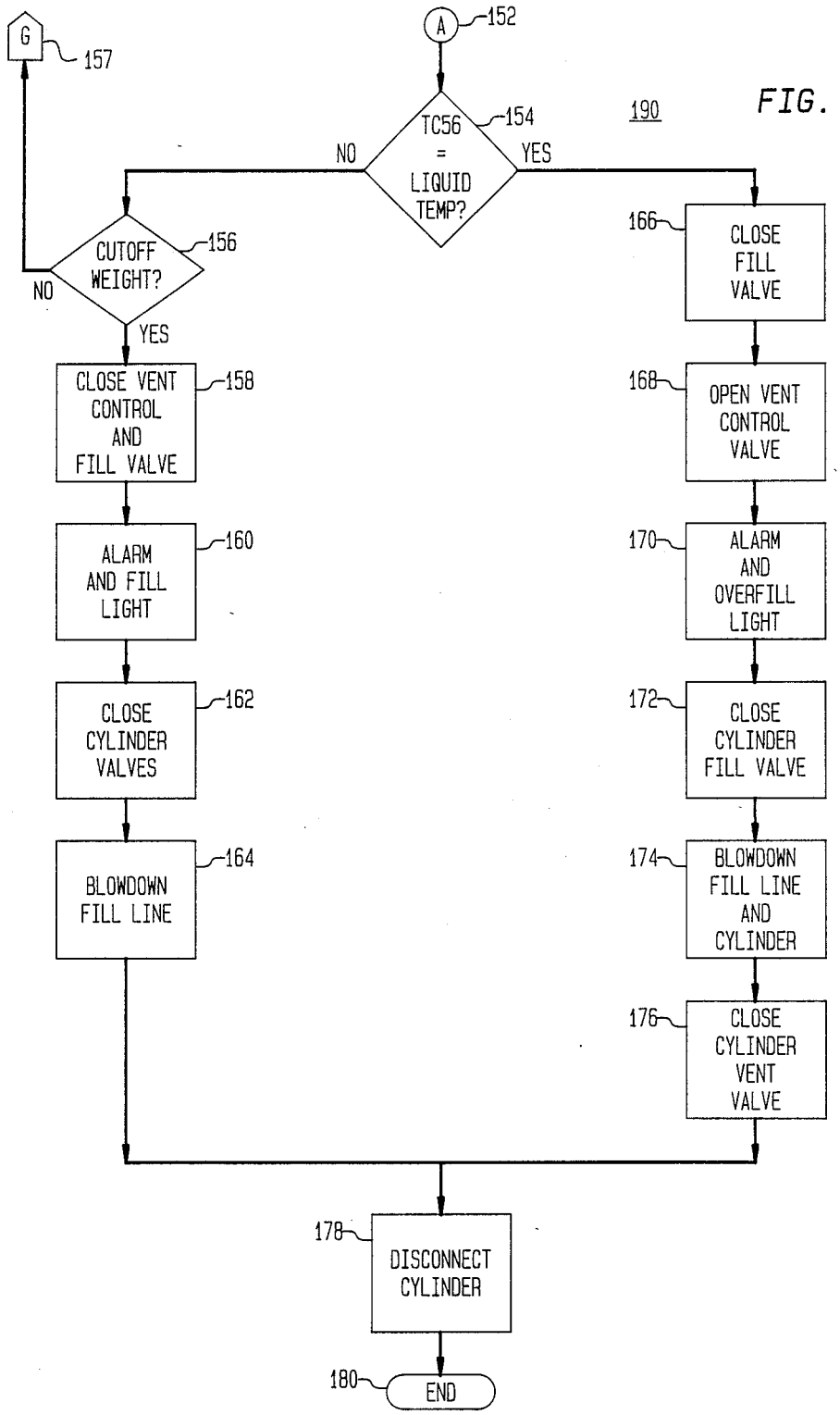
FIGS. 4 to 6 show continuations of the routine of FIG. 3.

Referring now to FIG. 4, execution proceeds from off page connector 150 of routine 110 to on page connector 152 of routine 190 and a determination is made at decision 154 whether the temperature of thermocouple 56 has reached the temperature of liquid substance 16 being transferred indicating an overfill error. If substance 16 being transferred is liquid nitrogen, the liquid temperature detected by thermocouple 56 is −310° F.; if substance 16 is liquid oxygen, the liquid temperature is −285° F.; for liquid argon, the temperature is −290° F.

In an alternate embodiment, a single low temperature set point of approximately −250° F. may be used for any of the above substances 16. In another alternate embodiment, substance 16 may be liquid hydrogen or helium and a suitable temperature set point is selected for these product gases. In another alternate embodiment, the low temperature set point is determined by controller 12 and is a function of the type of cryogenic substance 16 being transferred and cylinder 18 fill pressure as sensed by pressure transducer 66.

If the temperature of thermocouple 56 has not reached the temperature of liquefied substance 16 as determined by decision 154, liquefied substance 16 has not reached pipe 64 indicating that an overfill condition does not exist. Therefore, a determination is made at decision 156 whether the cutoff weight entered on dial 95 of scale 94 has been reached. To make this decision, controller 12 reads a single output bit of scale 94 by way of input line 98 in which the output bit of scale 95 indicates whether the weight of substance 16 in cylinder 18 has reached the weight set on dial 95. If the cutoff weight has not been reached, execution loops back to block 136 by way of off-page connector 157 and on-page connector 159. At block 136, the optimum differential pressure is again calculated and set as set forth in Appendix A pages 6,7 and Appendix B pages 7,9. If the pressure within tank 14 has changed since the last time block 36 was executed, the new value of pressure is used in the calculations of block 136 and a new value of optimum differential pressure is determined.

Thus, during the filling operation execution loops through decisions 154,156 waiting for the cutoff weight to be reached or, in the event of a failure of digital scale 94, for an overfill. When the cutoff weight has been reached as determined by decision 156, variable throttle vent valve 68 an solenoid controlled fill valve 28 are closed as shown in block 158 and a fill alarm and a fill light on scan panel 86 are activated by controller 12 by way of output line 88 as shown in block 160.

The operator of fill station 10 then closes cylinder valves 52,54 as indicated in block 162 and a blowdown is performed as shown in block 164. In the blowdown the lines which carry substance 16 are emptied to prevent vaporization of substance 16 within the lines from causing a pressure build up due to continued heat input from ambient temperature. Such a pressure build up could rupture a line. Cylinder 18 is then disconnected as shown in block 178 and execution is terminated at end 180.

If the temperature of thermocouple 56 is substantially equal to the liquid temperature as determined by decision 154, indicating an overfill, solenoid controlled fill valve 28 is closed by controller 12 as shown in block 166. Vent control valve 68 is fully opened to permit venting of the overflow of liquefied substance 16 through vent line 92 as indicated in block 168 and an alarm and an overfill light on scan panel 86 are activated as indicated in block 170.

Cylinder inlet valve 52 is then manually closed as indicated in block 172 and a blow down of the fill line and cylinder 18 is performed as shown in block 174. Cylinder outlet or vent valve 54 is then closed as indicated in block 174 and cylinder 18 is disconnected as shown in block 178.

Figure 5:
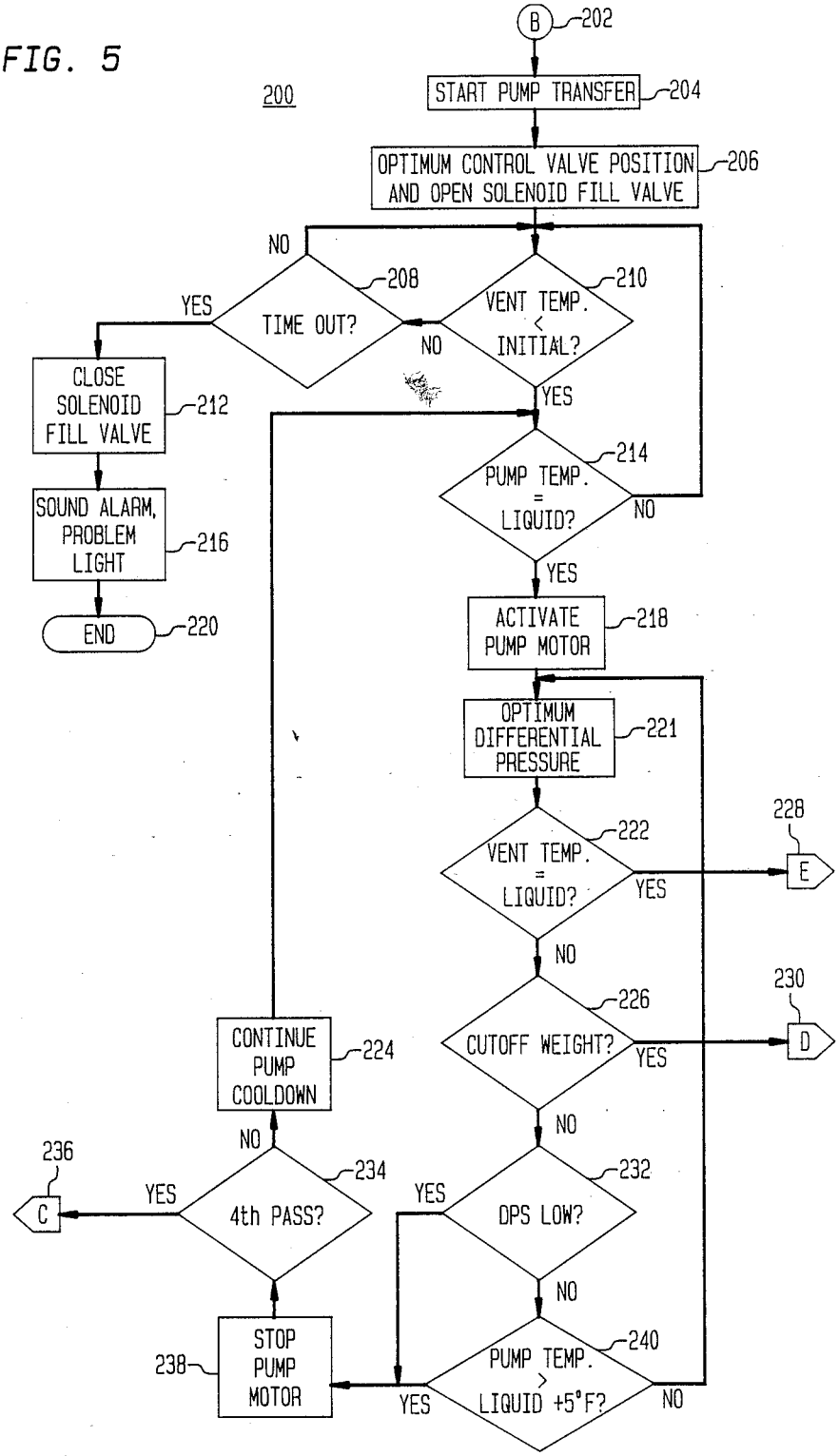

Referring now to FIG. 5, a flow chart representation of pump transfer routine 200 is shown. Execution proceeds to on page connector 202 of pump transfer routine 200 from off page connector 122 of routine 110 when a determination is made at decision 120 that pump transfer is to be performed. Pump transfer is started at block 204. The optimum back pressure, as determined from the optimum differential pressure set value stored in controller 12 and the pressure in tank 14, is set at block 206 by a signal by way of output line 90 from controller 12 to voltage to pneumatic transducer 74 which controls variable throttle vent valve 68 as previously described. Additionally, solenoid controlled valve 28 is opened to permit substance 16 to begin to flow through pipe 24 to cylinder 18.

Controller 12 then waits a predetermined period of time to determine whether substance 16 has actually begun to flow once solenoid controlled valve 28 is opened. This determination is made in the manner previously described at decision 210 in which the temperature in vent pipe 64, as monitored by thermocouple 56, is compared with the initial temperature when the transfer operation began. If the temperature of cylinder 18 has not fallen below the initial temperature as determined by decision 210, a determination is made by decision 208 whether the time out period has elapsed. If the time out period has not elapsed, execution loops between decisions 208,210 until either the time out period does elapse or the vent temperature decreases below the initial temperature.

If the vent temperature does not drop below the initial temperature before the end of the timeout period, indicating a possible failure condition such as improper cylinder 18 connection, solenoid controlled valve 28 is closed as shown in block 212, the alarm and error light of scan panel actuated in block 216, and routine 200 is terminated at end 220.

If the vent temperature does fall below the initial temperature before period, as determined by decisions 208,210, a determination is made at decision 214 whether pump 34 temperature has substantially reached the liquid temperature as calculated by controller 12 according to the tank 14 pressure received from pressure transducer 20. This indicates that pump 34 is sufficiently cool to prevent cavitation. Controller 12 determines the temperature of pump 34 by monitoring thermocouple 40 which produces a signal representative of the temperature within pipe 39 preferably within one foot of pump 34. This temperature drops when substance 16 reaches pipe 39 indicating that pump 34 is sufficiently cool to prevent cavitation.

The signal produced by thermocouple 40 is amplified by operational amplifier 42 and applied to controller 12 by way of input line 96. When pump 34 is sufficiently cool to prevent cavitation, pump motor 36 is activated by controller 12 by way of output line 84 as indicated in block 218 and the optimum pressure is calculated and set as shown in block 221 as set forth in Appendices A, B.

In an alternate embodiment, controller 12 may wait for a predetermined period of time after detecting the presence of liquefied substance 16 at the outlet of pump 34. This allows an additional cooling period to be certain that pump 34 is cool enough to prevent cavitation. However, if pump 34 is small enough, this is not necessary.

When pump motor 36 is actuated, determinations are made whether the temperature within pipe 64 has substantially reached liquid temperature to detect an overfill error and whether the weight within cylinder 18 has reached the cutoff weight as previously described in the description of pressure transfer. Thus, a determination is made at decision 222 whether the temperature of pipe 64, as indicated by the output of thermocouple 56, has substantially reached liquid temperature. If the temperature at pipe 64 has not reached liquid temperature, a determination is made in decision 226 whether the cutoff weight has been reached.

If the cutoff weight of substance 16 within cylinder 18 has not been reached as determined by decision 226, a determination is made at decision 232 whether the differential pressure between the input and the outlet of pump 34 is low indicating cavitation of pump 34. If the differential pressure as determined by differential pressure switch 48 is low as determined at decision 232, pump motor 36 is stopped as indicated in block 238, and a determination is made how many times this condition has arisen.

If the pump motor 36 shutdown condition has arisen less than four times, pump cooldown is permitted to continue as shown in block 224 and a determination is again made whether the pump temperature has substantially reached liquid temperature at decision 214. Valves 44,46 are provided at the inputs to differential pressure switch 48 to selectively prevent passage of substance 16 to differential pressure switch 48 and equalization valve 50 is provided to permit bypassing of differential pressure switch 48 for isolating differential pressure switch 48 from the rest of station 10, for example during maintenance.

If the differential pressure between the inlet and the outlet of pump 34 is not low, as indicated by differential pressure switch 48 in decision 232, a determination is made at decision 240 whether the temperature of pump 34, as determined from thermocouple 40, is greater than the liquid temperature +5° F. indicating an error condition in which substance 16 is not passing through pump 34 as expected. If the temperature of pump 34 is greater than the liquid temperature +5° F., pump motor 36 is stopped as shown in block 238.

If pump motor 36 has been stopped fewer than four times as determined in decision 234, cooldown is continued as previously described. If the pump temperature is not substantially greater than the liquid temperature +5° F., execution returns to decision 221 and station 10 continues filling cylinder 18 and waiting for the cutoff weight to be reached.

Thus, during the loading of substance 16 into cylinder 18 by the pump transfer method, fill station 10 monitors the cutoff weight at decision 226 and also monitors vent temperature at pipe 64, the differential pressure across pump 34 and the temperature of pump 34 to detect error conditions. It will be understood by one skilled in the art that these determinations, made at decisions 222,226,232 and 240, are shown as being performed sequentially by controller 12 but may be performed in parallel by a plurality of controllers or independent circuits. For example, a dedicated circuit for monitoring the temperature at vent pipe 64, independently of the programming of controller 12, may interrupt the loading operation when the temperature of vent pipe 64 reaches a predetermined low level.

Figure 6:
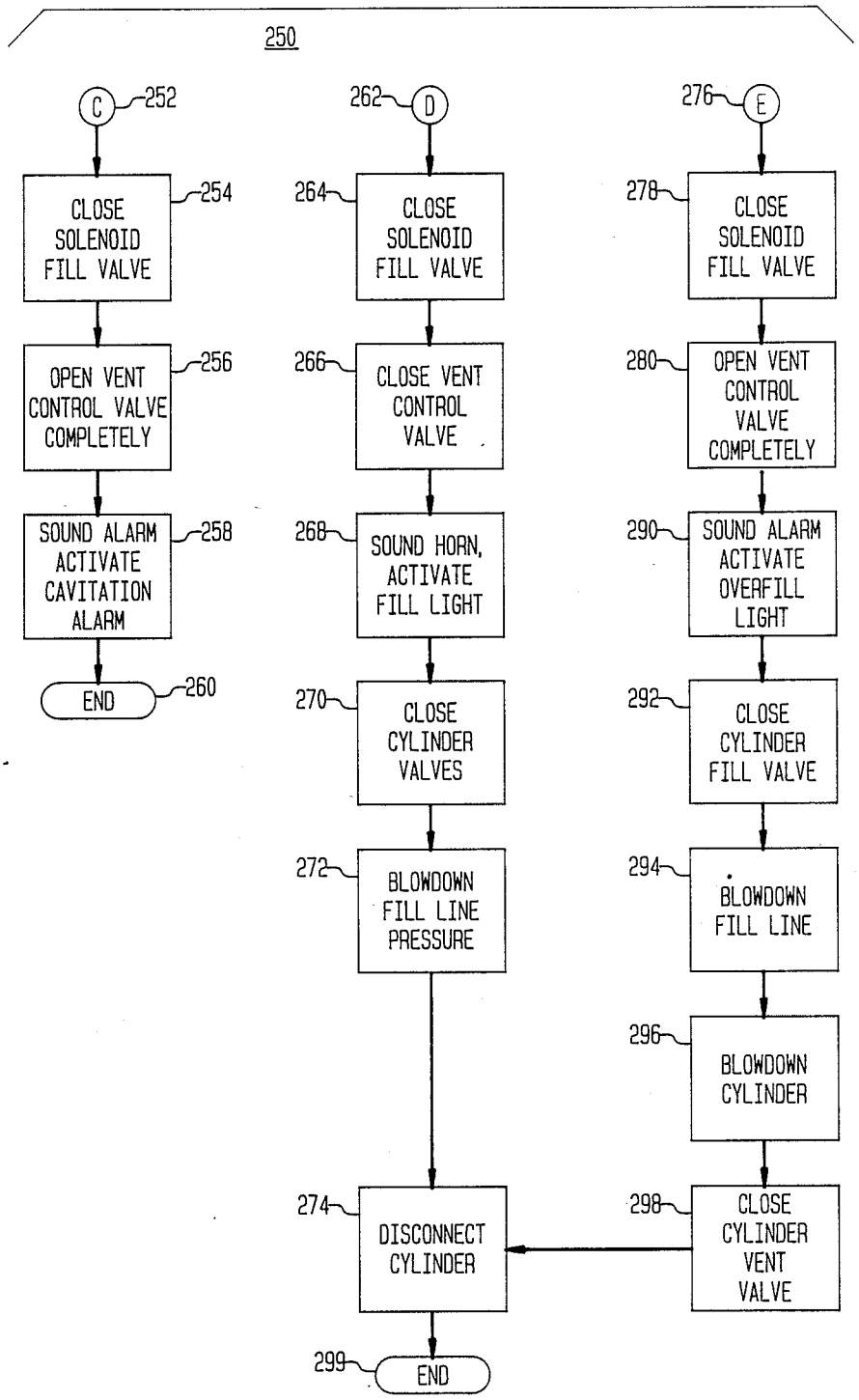

Referring now to FIG. 6, there is shown flow chart 250 which is a continuation of the operations of pump transfer routine 200. When pump motor 36 has been stopped at block 238 four times, either because the differential pressure of differential pressure switch 48 is low or the temperature of thermocouple 40 is high, execution proceeds from off page connector 236 of pump transfer routine 200 to on page connector 252 of routine 250. The choice of four as the number of passes through the routine stopping and restarting pump 34 is empirically chosen. Pumps such as pump 34 often require two startup attempts before catching prime.

After four startup attempts, solenoid controlled valve 28 is closed to terminate the flow of substance 16 as shown in block 254 and variable throttle vent valve 68 is completely opened to vent cylinder 18. Additionally, the alarm on scan panel 86 and a cavitation alarm on scan panel 86 are activated as shown in block 258 and execution is terminated at end 260.

When the cutoff weight of cylinder 18 has been reached as determined by decision 226 of routine 200, execution proceeds through off page connector 230 to on page connector 262 of routine 250. Because cylinder 18 has reached the required weight at this point, solenoid controlled fill valve 28 is closed as shown in block 264 and variable throttle vent control valve 68 is closed as shown in block 266. The horn and fill light of scan panel 86 are activated as shown in block 268. The operator then closes cylinder valves 52,54 as shown in block 270 and blow down is performed as indicated in block 272. The loading operation is then complete. Cylinder 18 is therefore disconnected as indicated in block 274 and execution is terminated at end 299.

During the loading of cylinder 18, if the temperature of pipe 64 reaches the temperature of the liquid being loaded, as determined by decision 222, indicating an overfill condition, execution proceeds through off page connector 228 of pump fill routine 200 to on page connector 276 of routine 250. During an overfill condition, the first operation performed is closing of solenoid controlled fill valve 28 to terminate the supply of substance 16 as indicated in block 278.

Vent control valve 68 is opened completely at block 280 to permit venting of liquefied substance 16 which has reached pipe 64. The alarm and overfill light of scan panel 86 are activated at block 290. The operator then closes cylinder inlet port 52 as shown in block 292 and a blowdown of the fill line is performed at block 294. Additionally, a blowdown of cylinder 18 must be performed at block 296 followed by closing cylinder vent valve 54 at block 298. Cylinder 18 may then be disconnected as shown at block 274.

Controller 12 is programmed to provide a separately identifiable error message for each error condition which may arise within station 10, for example the errors determined at decisions 134, 142, 154, 208, 232, 234, and 240. This permits an operator to easily determine which error condition has arisen. Additionally, the duration of each timeout period, such as those at decisions 134, 142, and 208, may be individually selected and optimized by adjusting corresponding time parameters within the program of controller 12.

Controller 12 also accumulates total pump running hours to indicate when scheduled maintenance is needed. In addition, total filling losses may be accumulated over time to assist in inventory control.

Figure 7:
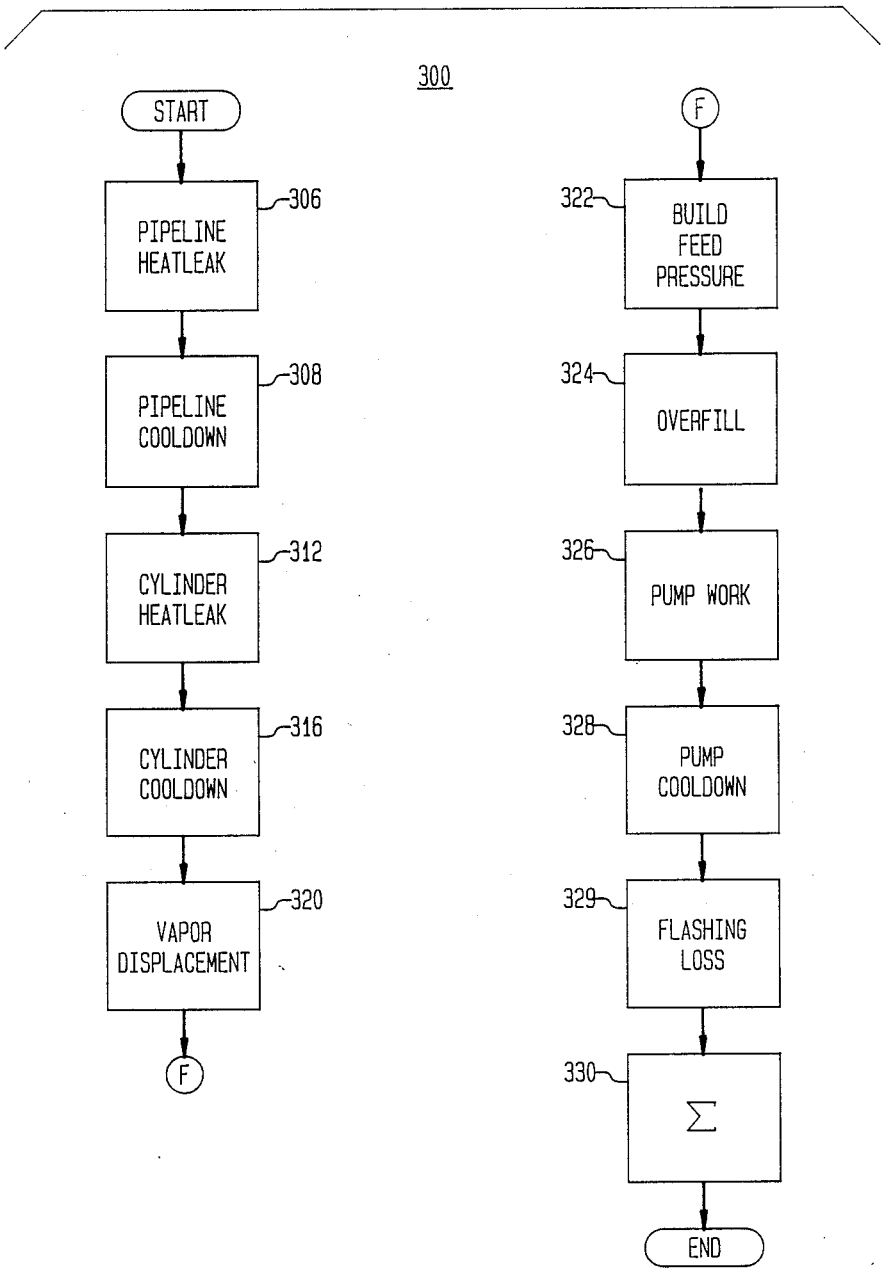
FIG. 7 shows a block diagram representation of a model for calculating cylinder filling losses.

Referring now to FIG. 7 there is shown a flow chart of model routine 300 for modelling filling losses during loading of cylinder 18 with a cryogenic substance 16. This model may be used to determine the optimum differential pressure for fill stations such as fill station 10 for minimizing filling losses. The optimum differential pressure for an individual fill station depends on many parameters such as the length, diameter, construction material and insulation material of the pipes through which substance 16 must pass to reach cylinder 18. The optimum differential pressure also depends on the type of cryogenic substance 16 which is transferred and may vary during the filling process.

The routines modelled by model 300 are run prior to the loading of cylinder 18 and accept as their inputs parameters relating to a specific fill station such as fill station 10. This model may be run repeatedly for a fill station with all parameters remaining constant except for the pressure of cylinder 18 and thereby the differential pressure between storage tank 14 and cylinder 18. The filling loss for each value of pressure within cylinder 18 is calculated by model 300 and an optimum differential pressure is selected by reference to these results and determining which value of differential pressure produces minimum loss of substance 16.

This optimum differential pressure is stored as a set point within controller 12 and compared with values of differential pressure determined during a pressure transfer. The values of differential pressure during a pressure transfer are determined by monitoring the pressure of tank 14 and the pressure of cylinder 18 using pressure transducers 20,66 respectively. The differential pressure of fill station 10 during pressure transfer is adjusted by adjusting the pressure in cylinder 18 with throttle valve 68 to a pressure set point determined from the optimum differential pressure set point and the pressure within tank 14.

Figure 8:
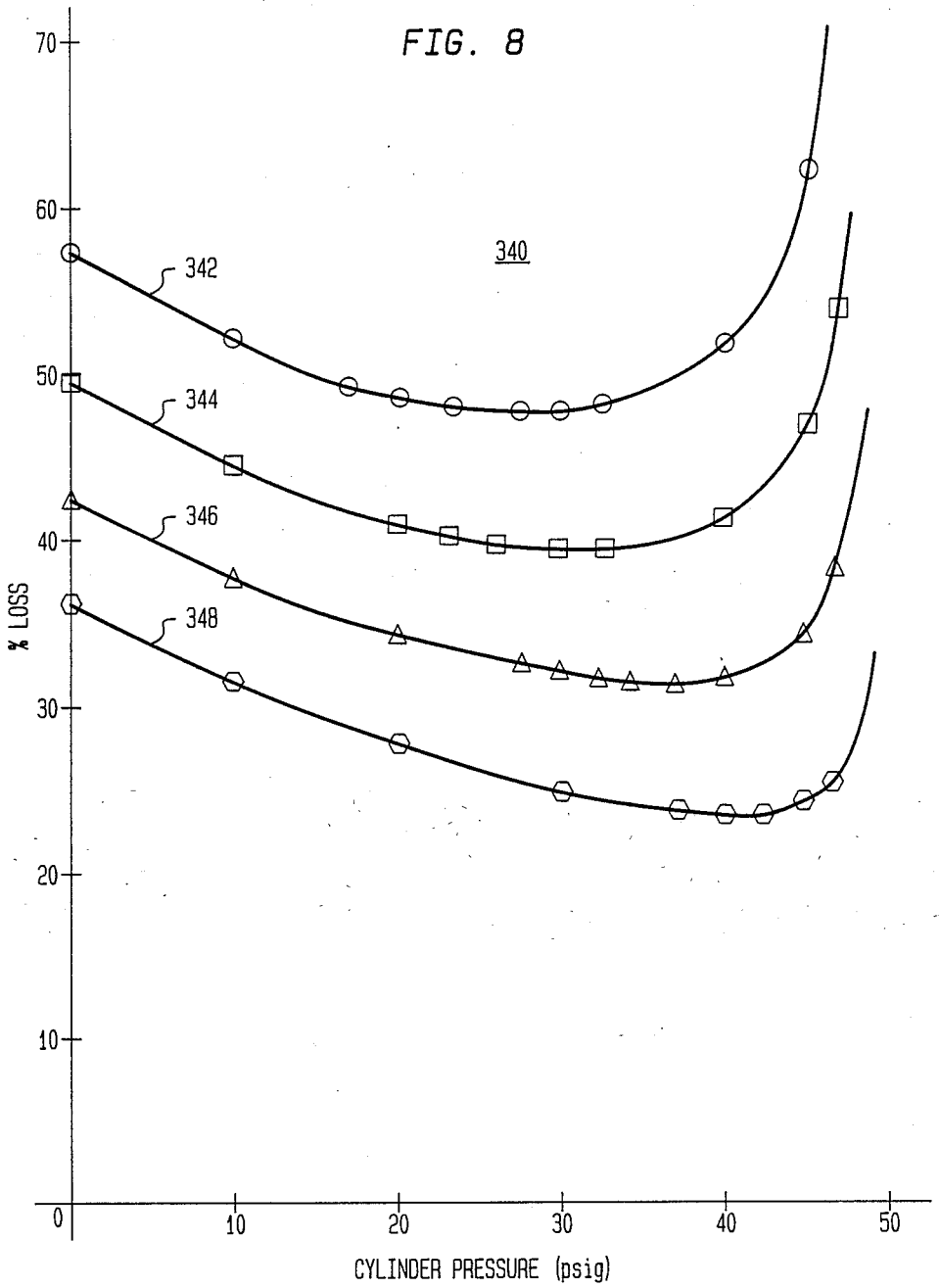
FIGS. 8 and 9 show graphs of filling loss as a function of cylinder pressure.
Figure 9:
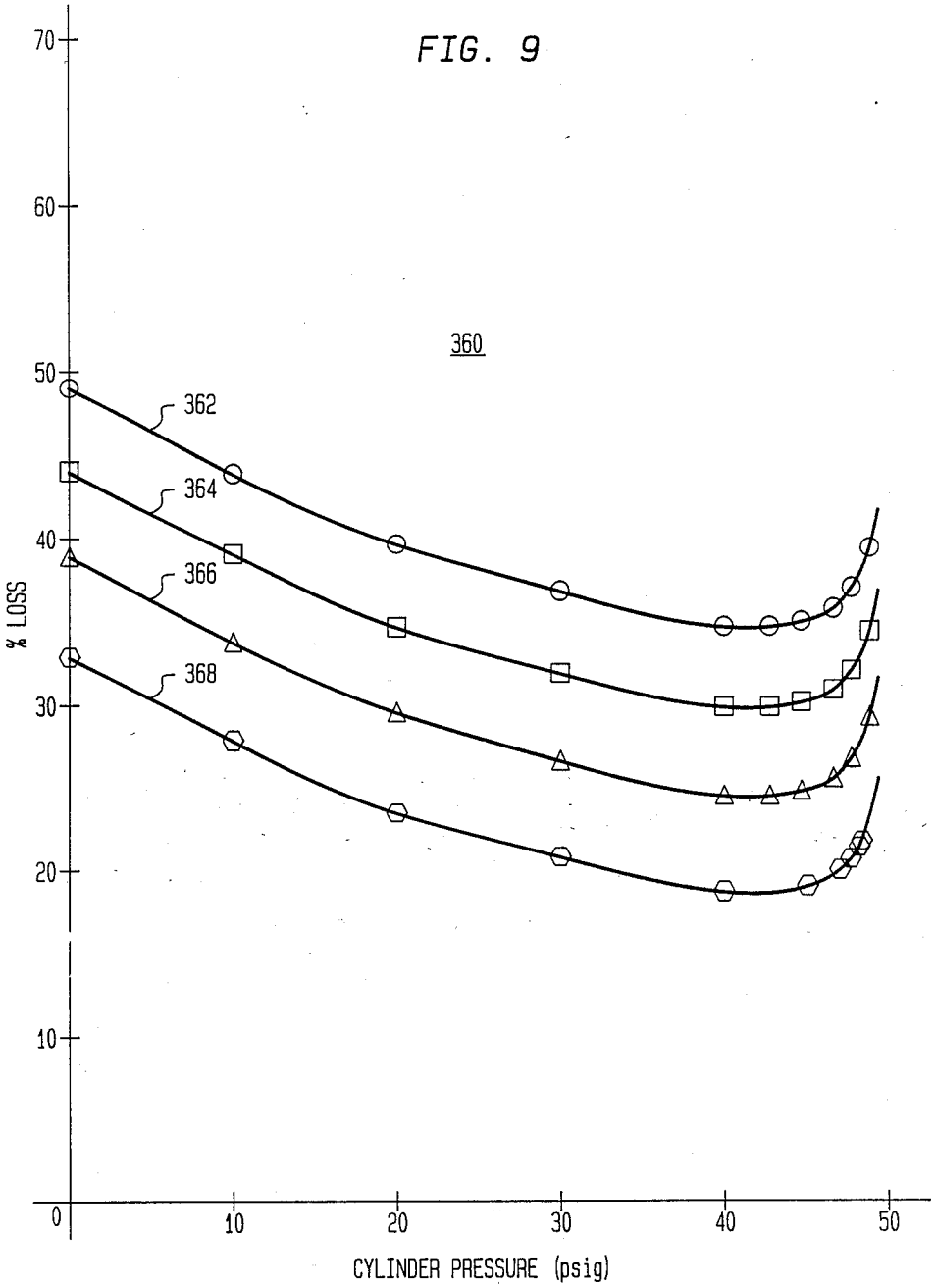

By repeatedly running model 300 as described, there may be produced graphs of filling loss versus cylinder pressure as shown in FIGS. 8 and 9 in which each line on graphs 340,360 represents a plurality of runs of model routine 300 for a single fill station in which the pressure within cylinder 18 is varied while the remaining parameters are kept constant. For example, the curves of graph 340 are all plotted for a fill station in which the tank pressure was constant at fifty psig, the outer diameter of the fill line was seven-eighths inch, and no insulation was present on the fill lines. The pressure within cylinder 18 was varied from zero to fifty psig. Curve 342 was plotted for a seven-eighths inch outer diameter fill line, a fill line length of one hundred feet and pressure within cylinder 18 varying from zero to fifty psig.

Curve 344 was plotted by holding the fill line length constant at seventy-five feet while varying the pressure within cylinder 18 from zero to fifty psig. Similarly, curves 346,348 were produced by holding the fill line length at fifty feet and at twenty-five feet respectively while varying the pressure within cylinder 18 over the same range. By reference to curves 342–348, it can be seen that when the pressure of cylinder 18 is varied while the remaining parameters are held constant, there is a cylinder pressure, and therefore a station differential pressure, which produces a minimum filling loss. This optimum differential pressure can vary greatly with fill line length, from eight psig at twenty-five feet to twenty-five psig at one hundred feet.

The curves of graph 360 are plotted with tank pressure held constant at fifty psig, a fill line outer diameter of seven-eighths inch and a one inch foam insulation on the fill line. Curves 362,364,366,368 were produced by inputting fill line lengths of one hundred feet, seventy-five feet, fifty feet and twenty-five feet, respectively, while varying the pressure of cylinder 18 between zero and fifty psig. As previously described, a minimum product loss may be determined for each curve 362–368.

Similar graphs may be prepared using model 300 for fill stations in which the tank pressure may be any desired value other than fifty psig, for example, seventy-five or one hundred psig. Additionally, runs of model 300 may be performed using any outer diameter fill line, such as one-half inch or five-eighth inch outer diameter. Such graphs may also be prepared for different thermal conductivity of materials, cylinder 18 fill volumes, substances 16, etc.

Thus, it may be seen that when a fill station is specified according to its fill line length, fill line outer diameter, insulation, etc., model 300 may be used to vary the pressure within cylinder 18 to determine the minimum fill loss as a function of differential pressure for that station.

At block 306 of model 300, pipe line heatleak due to convection ($Q_c$) and pipe line heatleak due to radiation ($Q_r$) are calculated. The convection heat loss ($Q_c$) is calculated according to:

$$Q_c = \frac{T_A - T_L}{(1/h_iA_i) + (\Delta r/kA_{1m})_{pipe} + (\Delta r/kA_{1m})_{insul} + 1/h_oA_o} \quad (1)$$

in which $T_A$ is the ambient temperature, $T_L$ is the liquid temperature, $h_i$ is the heat transfer coefficient of the wetted surface between the pipes carrying substance 16 and substance 16 itself, $A_i$ is the total wetted area between the pipes and substance 16, $\Delta r$ is the thickness of the pipe and of the insulation, respectively, $A_{lm}$ is the log mean of the pipe area or insulation area, $h_o$ is the heat transfer coefficient between the outer layer of insulation and ambient, and $A_o$ is the outer area of the insulation.

The pipeline heatleak due to radiation ($Q_R$), also calculated at block 306, is calculated as:

$$Q_R = \sigma\epsilon A_o(T^4_A - T^4_{surf}) \quad (2)$$

in which $\sigma$ is the Stephan-Boltzmann constant, $\epsilon$ is the emissivity constant of the outer surface of the insulation, $A_o$ is the outer pipe area, $T_A$ is the ambient temperature and $T_{surf}$ is the surface temperature of the insulation when the surface is assumed to have no ice.

At block 308 a determination is made of the amount of loss due to pipeline cool down ($Q_{PCD}$). This loss includes both the heat absorbed from the pipe and the heat absorbed from the insulation around the pipe. This determination is given as:

$$Q_{PCD} = (m_pC_p\Delta T)_{pipe} + K(m_iC_p\Delta T)_{insul} \quad (3)$$

in which $m_p$ is the mass of the entire pipeline which carries substance 16, $m_i$ is the mass of all the insulation respectively on the pipes which carry substance 16, $C_p$ is the specific heat for the pipes and for the insulation and $\Delta T$ is the difference between the initial pipe and insulation temperature and the temperature of substance 16. K is a percentage less than 100% which indicates the amount of insulation which is cooled, providing a temperature gradient across the insulation thickness between substance 16 temperature and ambient temperature.

Cylinder heatleak ($Q_{CH}$) is determined at block 312 from the normal evaporation rate (NER) of the substance being loaded assuming that an average of one-half of the final volume of cylinder 18 is exposed during the filling operation. Therefore cylinder heatleak is given as:

$$Q_{CH} = \frac{1/2\ (NER)w}{\Delta H^v} \quad (4)$$

in which NER is the normal evaporation rate which may be, for example, 1.5% per day for liquid oxygen at 1 atmosphere, w is the total cylinder liquid mass, and $\Delta H^v$ is the latent heat of vaporization for the liquid substance 16.

Cylinder cool down ($Q_{CCD}$) is calculated at block 316 assuming that there is no thermal resistance in the inner vessel within cylinder 18 and that 37% of the super insulation mass of cylinder 18 is cooled to liquid temperature during cylinder cool down. The heat loss due to cylinder cool down using these assumptions is:

$$QCCD=(M_vC_p\Delta T)_{INNER\ VESSEL}+0.37\ (M_iC_p\Delta T)_{SI\ INSUL} \quad (5)$$

in which $M_v$ is the mass of the inner vessel and Mi is the mass of the super insulation of cylinder 18.

At block 320 vapor displacement is calculated. When substance 16 first enters cylinder 18, some of substance 16 vaporizes filling cylinder 18 with vapor. This vapor is displaced by liquefied substance 16 as cylinder 18 is filled. The displaced vapor is vented through outlet vent 54. The displaced vapor is lost product gas and is calculated in block 320 in order to determine overall product loss. It is approximately equal to the volume of cylinder 18.

In order to build pressure within tank 14 for transfer of substance 16, substance 16 may be subcooled by passing substance 16 through external coils to cause a controlled amount of vaporization. The vapor generated is returned to the vapor space of tank 14. The vapor may be periodically vented to control the pressure within tank 14. This subcooling of substance 16 also helps prevent cavitation because substance 16 is transferred before it reaches liquid saturation at the higher pressure and substance 16 is thus less likely to vaporize when it reaches pump 34. The amount of product gas lost due to subcooling is determined in block 322. Losses due to overfills are determined in block 324.

The amount of work performed by pump 34 and pump motor 36 may also be included, and they are estimated in block 326 as the electrical power supplied to pump motor 36. The loss due to cool down of pump 34 is equal to the mass which is in contact with substance 16 multiplied by the specific heat of the material of construction and temperature differential between substance 16 temperature and initial pump temperatures, and this loss is calculated in block 328.

The Joule-Thompson flashing loss is calculated in block 329. This loss occurs when cryogenic substance 16 passes from a higher pressure region, such as a region substantially near tank 14, to a lower pressure region, such as a region substantially near cylinder 18. The transition from higher pressure to lower pressure causes some of substance 16 to boil off. Assuming isenthalpic conditions and using the "Lever Rule" on a pressure, temperature, enthalpy diagram, the flashing losses are calculated as:

$$\%\ loss=[(H_1^L-H_2^L)/H_2^v]100 \quad (6)$$

in which $H_1^L$ is the higher pressure enthalpy, $H_2^L$ is the lower pressure enthalpy, and $H_2^v$ is the latent heat. The percent loss calculated in equation (6) is multiplied by the total amount of product gas or substance 16 transferred from tank 14 to obtain the amount of substance 16 lost due to flashing.

In block 330 all of the losses calculated in blocks 306–329 are summed to determine the total filling loss and execution ends at terminal 332. The pipeline and cylinder heatleak losses are time dependent, therefore an iterative procedure must be used to obtain the total filling losses. The process represented by model 300 is then rerun for a plurality of different values of differential pressure between tank 14 and cylinder 18 while the remaining parameters specifying station 10 and substance 16 are held constant. A value of differential pressure is selected which produces a minimum amount of total filling loss at block 330.

This optimum differential pressure for station 10 is stored in controller 12 and used to adjust throttle vent valve 68 during filling. The entire process of performing a plurality of runs of model 300 and selecting an optimum differential pressure must be performed for each different configuration of a fill station and for each different product gas.

When model 300 is used to simulate filling losses due to pressure transfer, certain losses, such as the losses calculated in blocks 322, 326, 328 which are associated with pump 34, need not be calculated. A FORTRAN program, written in a structured form understandable to those of ordinary skill in the art, which performs the calculations required for calculating product loss during such a pressure transfer appears at the end of this specification as Appendix A.

Additionally, a FORTRAN program for calculating filling losses during pump transfer appears at the end of this specification as Appendix B. Since many of the losses simulated by model 300 occur during both pressure transfer and pump transfer the programs of Appendices A, B overlap. The program of Appendix B may be used to optimize the pressure of cylinder 18 with respect to the amount of venting loss due to subcooling.

The program of Appendix B may also be used to model the losses for sequential filling of a plurality of cylinders 18 by pump transfer. During the first filling of a cylinder 18 the losses due to building feed pressure calculated in block 322 and pump cooldown calculated in block 328 are higher than the losses due to these considerations during subsequent fillings because during subsequent fillings the pressure is already built up in tank 14 and pump 34 is already cooled down.

Thus, if model 300 as implemented in Appendix B is run a plurality of times in view of the changing values of temperature and pressure in tank 14 and temperature of pump 34, the total filling loss for a plurality of cylinders 18 may be determined. This information may be used to determine the minimum number of cylinders 18 which must be filled sequentially to make pump transfer economically desirable.

The first cylinder filled by pump transfer causes losses which are higher than the losses required to fill by pressure transfer because pressure transfer does not require subcooling of tank 14 or cooling of pump 34. However, subsequent fillings cause less filling loss than pressure transfer because substance 16 passes through station 10 more quickly causing less heatleak loss and less operator time. There is thus a crossover point after which filling by pump transfer is more econonomicaly desirable than filling by pressure transfer. By running model 300 repeatedly and summing the losses incurred for a plurality of cylinders 18 for both types of transfer, this crossover point may be determined.

The control code of Appendix C is written in MAC-BASIC, a controller version of BASIC, and is designed to run on an Analog Devices Micro Mac 6000 Controller Computer. The code is exemplified for a 50 foot, uninsulated ¾ inch copper fill line using liquid nitrogen. In general use, the appropriate curve generated by the FORTRAN simulations of Appendices A, B for a particular plant configuration and cryogenic substance is loaded into the control code, which then controls the operation of the filling system to maintain the optimum differential pressure.

APPENDIX A
Calculating Filling Losses

James VanOmmeran

APCI 222-P-USO-3303

©1988 Air Products and Chemicals, Inc.

```
*********************************************
*  LIQUID CYLINDER FILLING LOSSES PROGRAM   *
*********************************************

            (DATASET = LCOP)

                JVO 2/3/84


THIS PROGRAM CALCULATES THE LOSSES ASSOCIATED WITH LIQUID
CYLINDER FILLING.  IT HAS PROVISIONS FOR EITHER DIFFERENTIAL
PRESSURE OR PUMPED TRANSFERS, INSULATED OR UNINSULATED
LIQUID FILL LINES, AND EQUIPMENT (FILL LINE, CYLINDER AND
PUMP) INITIAL TEMPERATURES OTHER THAN AMBIENT.


THE FOLLOWING ITEMS ARE ASSUMED:

    LIQUID FILL LINE -- INNER HEAT TRANSFER COEFFICIENT = 500
                        BTU/HR*SQFT*DEG F

                        OUTER HEAT TRANSFER COEFFICIENT = 2
                        BTU/HR*SQFT*DEG F (NATURAL CONVECTION)

                        PIPE ROUGHNESS = 0.0020 FOR COMMERCIAL
                        COPPER TUBING WITH SOLDER JOINTS

    LIQUID CYLINDER -- GROSS CAPACITY = 176 LITERS

                       DIMENSIONS = 20 IN DIA., 60 IN HT.

                       STAINLESS STEEL DENSITY = 501 #/CUFT

                       STAINLESS STEEL HEAT CAPACITY = 0.066
                       BTU/#*DEG F

                       SUPER INSULATION DENSITY = 4.78 #/CUFT

                       SUPER INSULATION HEAT CAPACITY = 0.26
                       BTU/#*DEG F

    PUMP (IF REQUIRED) -- PUMP EFFICIENCY = 40%


THE FOLLOWING ARE DEFAULT VALUES:

    LIQUID FILL LINE -- COPPER PIPE DENSITY = 556 #/CUFT

                        COPPER PIPE THERMAL CONDUCTIVITY = 290
                        BTU/HR*FT*DEG F

                        COPPER PIPE HEAT CAPACITY = 0.062
                        BTU/#*DEG F

                        COPPER PIPE EMISSIVITY CALCULATED FOR
                        OXIDIZED CU AT AVERAGE PIPE
                        TEMPERATURE AND EXPOSED TO AIR
                        (UNINSULATED)

                        POLYURETHANE FOAM INSULATION DENSITY
                        = 4 #/CUFT
```

POLYURETHANE FOAM INSULATION THERMAL CONDUCTIVITY = 0.0125 BTU/HR*FT*DEG F

POLYURETHANE FOAM INSULATION HEAT CAPACITY = 0.30 BTU/#*DEG F

WHITE JACKET EMISSIVITY = 0.85 (INSULATED)

LIQUID CYLINDER -- LIQUID WEIGHT FOR FULL CYLINDER AS REGULATED BY HM-115 FOR 4L CYLINDERS WITH 235 PSIG PRESSURE RELIEF VALVE OR BY NOMINAL CYLINDER LIQUID VOLUME -- WHICHEVER IS LESS

LIN MAX WEIGHT = 224.7 #
LOX MAX WEIGHT = 319.1 #
LAR MAX WEIGHT = 379.6 #
-- OR --
LIN MAX VOLUME = 148 LITERS
LOX MAX VOLUME = 148 L
LAR MAX VOLUME = 145 L

CYLINDER NORMAL EVAPORATION RATE
LIN = 2.2 %/DAY
LOX = 1.5 %/DAY
LAR = 1.5 %/DAY

INITIAL TEMPERATURES -- INITIAL TEMPERATURES FOR THE LIQUID FILL LINE, CYLINDER AND PUMP (IF REQUIRED) = SPECIFIED AMBIENT TEMPERATURE

******** INPUT DATA REQUIRED ********

LINE 1: NUMBER OF CASES BEING RUN

LINE 2: PIPE LENGTH (FT), PIPE OD (IN), PIPE WALL THICKNESS (IN), INSULATION THICKNESS (IN), TANK PRESSURE (PSIG), CYLINDER FILL PRESSURE (PSIG), TANK LIQUID HEIGHT (IN)

LINE 3: AMBIENT TEMPERATURE (DEG F), LIQUID TYPE (LIN=0, LOX=1, LAR=2), FILL LINE EQUIVALENT VELOCITY HEADS, CYLINDER VALVE ELEVATION ABOVE LOWEST POINT OF FILL LINE (FT), PUMP CAPACITY (GPM)

******** INPUT DATA TO OVERRIDE DEFAULT VALUES ********

LINE 4: LIQUID FILL WEIGHT (#), PIPE INITIAL TEMPERATURE (DEG F), CYLINDER INITIAL TEMPERATURE (DEG F), PUMP INITIAL TEMPERATURE (DEG F), PIPE DENSITY (#/CUFT), PIPE THERMAL CONDUCTIVITY (BTU/HR*FT*DEG F), PIPE HEAT CAPACITY (BTU/#*DEG F)

LINE 5: INSULATION DENSITY (#/CUFT), INSULATION THERMAL CONDUCTIVITY (BTU/HR*FT*DEG F), INSULATION HEAT CAPACITY (BTU/#*DEG F), EMISSIVITY, CYLINDER NORMAL EVAPORATION RATE (%/DAY)

******** FORTRAN PROGRAM ********

```
 REAL IALM,IAO,IDENS,INSCP,ITHRML,K,KF,LIQDEN,LIQHT,
1     LIQMW,LIQTYP,LIQVEL,LIQVIS,LIQVOL,LIQWT,MULTIP,NEV

     **** READ INPUT VARIABLES ****
```

```
      READ(5,250) NUMBER
      DO 240 I=1,NUMBER
      READ(5,260) PIPEL,PIPEOD,PIPETH,PIPEIN,TPRESS,CFILLP,LIQHT
      READ(5,270) AMBT,LIQTYP,KF,ELEV,SPGPM
      READ(5,280) LIQWT,PINTT,CINTT,PMPINT,PDENS,PTHRML,PIPECP
      READ(5,290) IDENS,ITHRML,INSCP,EMISS,NEV

          **** SET DEFAULT VARIABLES ****

      FULL=0.
      TL=0.
      HO=2.
      HI=500.
      F=0.006
      K=0.001969
      IF(LIQWT .NE. 0.0) GO TO 5
      IF(LIQTYP .EQ. 0.0 .AND. CFILLP .LE. 99.1) LIQWT=224.7
      IF(LIQTYP .EQ. 0.0 .AND. CFILLP .GT. 99.1) LIQVOL=148.
      IF(LIQTYP .EQ. 1.0 .AND. CFILLP .LE. 117.5) LIQWT=319.1
      IF(LIQTYP .EQ. 1.0 .AND. CFILLP .GT. 117.5) LIQVOL=148.
      IF(LIQTYP .EQ. 2.0 .AND. CFILLP .LE. 172.1) LIQWT=379.6
      IF(LIQTYP .EQ. 2.0 .AND. CFILLP .GT. 172.1) LIQVOL=145.
    5 IF(PDENS .EQ. 0.0) PDENS=556.
      IF(PTHRML .EQ. 0.0) PTHRML=290.
      IF(PIPECP .EQ. 0.0) PIPECP=0.062
      IF(PIPEIN .EQ. 0.0) GO TO 10
      IF(IDENS .EQ. 0.0) IDENS=4.
      IF(ITHRML .EQ. 0.0) ITHRML=0.0125
      IF(INSCP .EQ. 0.0) INSCP=0.30
   10 IF(EMISS .EQ. 0.0 .AND. PIPEIN .NE. 0.0) EMISS=0.85
      IF(NEV .EQ. 0.0 .AND. LIQTYP .EQ. 0.0) NEV=2.2
      IF(NEV .EQ. 0.0 .AND. LIQTYP .NE. 0.0) NEV=1.5
      IF(LIQTYP .EQ. 1.0) GO TO 20
      IF(LIQTYP .EQ. 2.0) GO TO 30

          **** PHYSICAL PROPERTY COEFFICIENTS FOR LIN ****

      ATSAT=11.692
      BTSAT=-1253.7
      ADENL=52.503
      BDENL=0.1058
      CDENL=-8.7997E-4
      ALHEAT=1512.7
      BLHEAT=20.077
      CLHEAT=-0.098433
      AVISCL=-6.3648
      BVISCL=1139.2
      CVISCL=-57986.
      ALIQH=-668.426
      BLIQH=4.1241
      CLIQH=0.0320963
      LIQMW=28.013
      GO TO 40

          **** PHYSICAL PROPERTY COEFFICIENTS FOR LOX ****

   20 ATSAT=11.972
      BTSAT=-1509.8
      ADENL=78.107
      BDENL=0.058599
      CDENL=-6.5093E-4
      ALHEAT=2726.0
      BLHEAT=9.8437
      CLHEAT=-0.052835
      AVISCL=-5.4165
      BVISCL=1139.7
      CVISCL=-63282.
      ALIQH=-1675.02
      BLIQH=9.40676
      CLIQH=0.0116992
      LIQMW=31.999
      GO TO 40

          **** PHYSICAL PROPERTY COEFFICIENTS FOR LAR ****

   30 ATSAT=11.782
      BTSAT=-1427.5
```

```
ADENL=90.876
BDENL=0.1187
CDENL=-9.2913E-4
ALHEAT=2546.1
BLHEAT=10.311
CLHEAT=-0.065289
AVISCL=-5.2325
BVISCL=1074.7
CVISCL=-57770.
ALIQH=-1445.211
BLIQH=6.77447
CLIQH=0.0133888
LIQMW=39.948

      **** 2-PHASE FLOW PSUEDO EQUIVALENT VELOCITY HEAD COEF ****

AKF=0.98663
BKF=0.0026729
CKF=4.3929E-4
DKF=-2.8417E-6
EKF=6.4257E-9

      **** CALCULATE PHYSICAL PROPERTIES ****

TNKTMP=BTSAT/(ALOG(TPRESS+14.7)-ATSAT)
LIQDEN=ADENL+BDENL*TNKTMP+CDENL*(TNKTMP**2)
STHEAD=LIQDEN*LIQHT/12./144.
BOTPRS=TPRESS+STHEAD+14.7
TEMP=BTSAT/(ALOG(CFILLP+14.7)-ATSAT)
LIQDEN=ADENL+BDENL*TEMP+CDENL*(TEMP**2)
DELTAH=ALHEAT+BLHEAT*TEMP+CLHEAT*(TEMP**2)
CLIQEN=ALIQH+BLIQH*TEMP+CLIQH*(TEMP**2)
TLIQEN=ALIQH+BLIQH*TNKTMP+CLIQH*(TNKTMP**2)
LIQVIS=EXP(AVISCL+BVISCL/TEMP+CVISCL/(TEMP**2))
DELTAP=BOTPRS-14.7-CFILLP
TEMP=TEMP-459.7
MULTIP=AKF+BKF*DELTAP+CKF*(DELTAP**2)+DKF*(DELTAP**3)
      +EKF*(DELTAP**4)
KF=KF*MULTIP
IF(PIPEIN .NE. 0.0) GO TO 60

      **** CALCULATE PIPE CONVECTION AND RADIATION HEATLEAK ****
                        **** UNINSULATED ****

IF(EMISS .NE. 0.0) GO TO 45
AVPTMP=(AMBT+459.7)*0.25+(TEMP+459.7)*0.75
EMISS=0.76473+7.1438E-4*AVPTMP+3.3012E-7*(AVPTMP**2)
PAO=3.1416*(PIPEOD/12.)*PIPEL
PIPEID=PIPEOD-2.*PIPETH
PAI=3.1416*(PIPEID/12.)*PIPEL
PALM=(PAO-PAI)/ALOG(PAO/PAI)
CONV=(AMBT-TEMP)/(1/HI/PAI+PIPETH/(12.*PTHRML*PALM)+1/HO/PAO)
TSURF=AMBT-CONV/(HO*PAO)
RAD=.1714E-8*EMISS*PAO*((AMBT+459.7)**4-(TSURF+459.7)**4)
PHTLK=CONV+RAD

      **** CALCULATE PIPE COOLDOWN ****

IF(PINTT .NE. 0.0) GO TO 50
PINTT=AMBT
PCOOLD=PDENS*3.1416/4.*((PIPEOD/12.)**2-(PIPEID/12.)**2)*PIPECP
      *PIPEL*(PINTT-TEMP)
GO TO 90

      **** CALCULATE PIPE CONVECTION AND RADIATION HEATLEAK ****
                        **** INSULATED ****

PAO=3.1416*(PIPEOD/12.)*PIPEL
PIPEID=PIPEOD-2.*PIPETH
PAI=3.1416*(PIPEID/12.)*PIPEL
PALM=(PAO-PAI)/ALOG(PAO/PAI)
IAO=3.1416*((2.*PIPEIN+PIPEOD)/12.)*PIPEL
IALM=(IAO-PAO)/ALOG(IAO/PAO)
CONV=(AMBT-TEMP)/(1/HI/PAI+PIPETH/(12.*PTHRML*PALM)+
     PIPEIN/(12.*ITHRML*IALM)+1/HO/IAO)
TSURF=AMBT-CONV/(HO*IAO)
RAD=.1714E-8*EMISS*IAO*((AMBT+459.7)**4-(TSURF+459.7)**4)
```

```
      PHTLK=CONV+RAD

          **** CALCULATE PIPE AND INSULATION COOLDOWN ****

      IF(PINTT .NE. 0.0) GO TO 70
      PINTT=AMBT
      PINTLM=AMBT
      GO TO 80
   70 PINTLM=(TSURF-PINTT)/ALOG((TSURF+459.7)/(PINTT+459.7))-459.7
   80 PITLM=(TSURF-TEMP)/ALOG((TSURF+459.7)/(TEMP+459.7))-459.7
      PCOOLD=PDENS*3.1416/4.*((PIPEOD/12.)**2-(PIPEID/12.)**2)*PIPECP
     1        *PIPEL*(PINTT-TEMP)+IDENS*3.1416/4.*(((2.*PIPEIN+PIPEOD)
     2        /12.)**2-(PIPEOD/12.)**2)*INSCP*PIPEL*(PINTLM-PITLM)

          **** CALCULATE CYLINDER HEATLEAK ****

   90 IF(LIQWT .NE. 0.0) GO TO 95
      LIQVOL=LIQVOL/28.31685
      LIQWT=LIQVOL*LIQDEN
      FULL=1.0
      GO TO 97
      IF(LIQTYP .EQ. 0.0 .AND. LIQWT .GE. 224.7) FULL=1.0
      IF(LIQTYP .EQ. 1.0 .AND. LIQWT .GE. 319.1) FULL=1.0
      IF(LIQTYP .EQ. 0.0 .AND. LIQWT .GE. 379.6) FULL=1.0
      LIQVOL=LIQWT/LIQDEN
   97 GALLON=LIQVOL*7.481
      CHTLK=.5*(NEV/100.)*LIQWT*(1./LIQMW)*DELTAH*(1./24.)

          **** CALCULATE CYLINDER AND INSULATION COOLDOWN ****

      IF(CINTT .NE. 0.0) GO TO 100
      CINTT=AMBT
  100 CCOOLD=501.*3.1416*.04787*.066*(CINTT-TEMP)+4.78*3.1416*.5068
     1        *0.26*36.7/100.*(CINTT-TEMP)

          **** CALCULATE JOULE-THOMPSON FLASHING LOSS ****

      FLASH=(TLIQEN-CLIQEN)/DELTAH
      FSHPCT=FLASH*100.

          **** GUESS INITIAL FLOW IS 5 GPM ****

      IF(SPGPM .NE. 0.0) GO TO 180
      DMPINT=AMBT
      STPLOS=LIQDEN*ELEV/144.
      VEL=5.*144./7.481/60./(3.1416*(PIPEID/2.)**2)

          **** ITERATION FOR FRICTION FACTOR ****

  120 RE=LIQDEN*VEL*PIPEID/12./(LIQVIS/3600.)
  130 FF=(1./(-4.*ALOG10(K/PIPEID*4.67/RE/(F**.5))+2.28))**2
      FERR=ABS(FF-F)
      IF(FERR .LT. .0001) GO TO 140
      F=FF
      GO TO 130

          **** ITERATION FOR LIQUID VELOCITY IN FILL LINE ****

  140 LIQVEL=((DELTAP-STPLOS)*144./(2.*FF*LIQDEN*PIPEL/(PIPEID/12.)/
     1        32.2+LIQDEN*KF/2./32.2))**.5
      VERR=ABS(LIQVEL-VEL)
      IF(VERR .LT. .02) GO TO 150
      VEL=LIQVEL
      GO TO 120
  150 GPM=LIQVEL*60.*7.481*3.1416/4.*(PIPEID/12.)**2

          **** CALCULATE CYLINDER FILL TIME ****

  160 TIME=LIQVOL*7.481/GPM

          **** CALCULATE TOTAL CYLINDER FILLING LOSSES ****

      SUBLOS=(((PHTLK+CHTLK)*TIME/60.+PCOOLD+CCOOLD)/DELTAH*LIQMW)
      ABSFSH=(LIQWT+SUBLOS)*FLASH
      TLOSS=SUBLOS+ABSFSH

          **** CALCULATE ERROR FOR FILLING LOSSES ITERATION ****
```

```
      ERROR=ABS(TLOSS-TL)
      IF(ERROR .GT. 0.05) GO TO 170
      GO TO 200

          **** ITERATION FOR TOTAL FILLING LOSSES ****

170   TL=TLOSS
      LIQVOL=(LIQWT+TLOSS)/LIQDEN
      GO TO 160

          **** CALCULATE PUMP HEAT INPUT ****

180   LIQVEL=SPGPM/60./7.481/(3.1416/4.*(PIPEID/12.)**2)
      HEADL=0.008*PIPEL/(PIPEID/12.)*(LIQVEL**2)/2./32.2+.5/32.2
     1       *(2*.75*6+1)*LIQVEL**2
      DELTAP=HEADL*LIQDEN/144.
      BHP=DELTAP*SPGPM/1713./.40
      TIME=LIQVOL*7.481/SPGPM
      PMPHT=2545.*BHP

          **** CALCULATE PUMP COOLDOWN ****

      IF(PMPINT .NE. 0.0) GO TO 190
      PMPINT=AMBT
190   PMPCLD=20.*.066*(PMPINT-TEMP)

          **** CALCULATE TOTAL CYLINDER FILLING LOSSES ****

      TLOSS=((PHTLK+CHTLK+PMPHT)*TIME/60.+PCOOLD+CCOOLD+PMPCLD)/
     1       DELTAH*LIQMW+VAPDIS

          **** CALCULATE OUTPUT PERCENTAGE LOSSES VARIABLES ****

200   PHTLK=PHTLK*TIME/60./DELTAH*LIQMW
      CHTLK=CHTLK*TIME/60./DELTAH*LIQMW
      PMPHT=PMPHT*TIME/60./DELTAH*LIQMW
      PCOOLD=PCOOLD/DELTAH*LIQMW
      CCOOLD=CCOOLD/DELTAH*LIQMW
      PMPCLD=PMPCLD/DELTAH*LIQMW
      P1=PHTLK/TLOSS*100.
      P2=PCOOLD/TLOSS*100.
      P3=CHTLK/TLOSS*100.
      P4=CCOOLD/TLOSS*100.
      P5=PMPHT/TLOSS*100.
      P6=PMPCLD/TLOSS*100.
      P7=ABSFSH/TLOSS*100.
      TOTP=TLOSS/LIQWT*100.

          **** PRINT OUTPUT ****

      WRITE(6,300)
      WRITE(6,310)
      WRITE(6,315)
      WRITE(6,320)
      WRITE(6,330)
      WRITE(6,340) I
      WRITE(6,350)
      WRITE(6,360)
      WRITE(6,370)
      IF(LIQTYP .EQ. 0.0) WRITE(6,380) PIPEL,PIPEOD
      IF(LIQTYP .EQ. 1.0) WRITE(6,390) PIPEL,PIPEOD
      IF(LIQTYP .EQ. 2.0) WRITE(6,400) PIPEL,PIPEOD
      IF(PIPEIN .EQ. 0.0) WRITE(6,410) PIPETH,CFILLP
      IF(PIPEIN .NE. 0.0) WRITE(6,420) PIPETH,PIPEIN,CFILLP
      IF(FULL .EQ. 0.0) WRITE(6,430) AMBT,LIQWT,GPM
      IF(FULL .EQ. 1.0) WRITE(6,435) AMBT,LIQWT,GPM
      IF(SPGPM .EQ. 0.0) WRITE(6,440) DELTAP,KF,ELEV
      IF(SPGPM .NE. 0.0) WRITE(6,450) KF,ELEV
      IF(SPGPM .EQ. 0.0) GO TO 210
      IF(PINTT .EQ. AMBT .AND. CINTT .EQ. AMBT .AND. PMPINT .EQ.
     1   AMBT) GO TO 220
      WRITE(6,460) PINTT,CINTT,PMPINT
      GO TO 230
210   IF(PINTT .EQ. AMBT .AND. CINTT .EQ. AMBT) GO TO 220
      WRITE(6,470) PINTT,CINTT
      GO TO 230
```

```
220 WRITE(6,480) AMBT
230 WRITE(6,490)
    WRITE(6,500)
    WRITE(6,510) GALLON,TEMP,FSHPCT
    WRITE(6,520) LIQDEN,LIQVIS,DELTAH
    WRITE(6,530) LIQVEL,RE,FF
    WRITE(6,540)
    WRITE(6,550)
    WRITE(6,560) PHTLK,P1
    WRITE(6,570) PCOOLD,P2
    WRITE(6,580) CHTLK,P3
    WRITE(6,590) CCOOLD,P4
    WRITE(6,620) ABSFSH,P7
    WRITE(6,630)
    WRITE(6,640) TLOSS
    WRITE(6,650) TOTP
    WRITE(6,660) TIME
    IF(SPGPM .NE. 0.0) WRITE(6,670) BHP
240 CONTINUE

        **** I/O FORMAT STATEMENTS ****

250 FORMAT(4X,I2)
260 FORMAT(2X,7(F9.4))
270 FORMAT(2X,5(F9.4))
280 FORMAT(2X,7(F9.4))
290 FORMAT(2X,5(F9.4))
300 FORMAT('1',3(/),39X,54('*'))
310 FORMAT(39X,5('*'),3X,'LIQUID CYLINDER FILLING LOSSES RESULTS',
   1        3X,5('*'))
315 FORMAT(39X,5('*'),11X,'- PRESSURE TRANSFER -',11X,5('*'))
320 FORMAT(39X,54('*'))
330 FORMAT(/,/,59X,17('-'))
340 FORMAT(59X,'\ CASE RUN =',I3,' \')
350 FORMAT(59X,17('-'))
360 FORMAT(/,/,/,62X,'INPUT DATA')
370 FORMAT(62X,10('-'))
380 FORMAT(/,/,1X,'LIN CYLINDER FILL PERFORMED',18X,
   1        'PIPE LENGTH =',F6.1,' FT',23X,'PIPE OD =',F6.3,' IN')
390 FORMAT(/,/,1X,'LOX CYLINDER FILL PERFORMED',18X,
   1        'PIPE LENGTH =',F6.1,' FT',23X,'PIPE OD =',F6.3,' IN')
400 FORMAT(/,/,1X,'LAR CYLINDER FILL PERFORMED',18X,
   1        'PIPE LENGTH =',F6.1,' FT',23X,'PIPE OD =',F6.3,' IN')
410 FORMAT(1X,'PIPE WALL THICKNESS =',F6.3,' IN',15X,
   1        'NO PIPE INSULATION',27X,'CYLINDER FILL PRESSURE =',
   2        F6.1,' PSIG')
    FORMAT(1X,'PIPE WALL THICKNESS =',F6.3,' IN',15X,
   1        'INSULATION THICKNESS =',F5.2,' IN',17X,
   2        'CYLINDER FILL PRESSURE =',F6.1,' PSIG')
430 FORMAT(1X,'AMBIENT TEMPERATURE =',F6.1,' DEG F',12X,
   1        'CYLINDER LIQUID WEIGHT =',F6.1,' #',13X,
   2        'VOLUMETRIC FLOWRATE =',F6.2,' GPM')
435 FORMAT(1X,'AMBIENT TEMPERATURE =',F6.1,' DEG F',12X,
   1        'CYLINDER LIQUID WEIGHT =',F6.1,' #  (FULL)',5X,
   2        'VOLUMETRIC FLOWRATE =',F6.2,' GPM')
440 FORMAT(1X,'TRANSFER DIFFERENTIAL PRESSURE =',F6.1,' PSI',3X,
   1        'FILL LINE EQUIVALENT VELOCITY HEADS =',F6.1,2X,
   2        'CYLINDER ELEVATION =',F5.1,' FT')
450 FORMAT(1X,'PUMPED TRANSFER',28X,
   1        'FILL LINE EQUIVALENT VELOCITY HEADS =',F6.1,2X,
   2        'CYLINDER ELEVATION =',F5.1,' FT')
460 FORMAT(1X,'INITIAL PIPE TEMPERATURE =',F7.1,' DEG F',6X,
   1        'INITIAL CYLINDER TEMPERATURE =',F7.1,' DEG F',2X,
   2        'INITIAL PUMP TEMPERATURE =',F7.1,' DEG F')
470 FORMAT(1X,'INITIAL PIPE TEMPERATURE =',F7.1,' DEG F',6X,
   1        'INITIAL CYLINDER TEMPERATURE =',F7.1,' DEG F')
480 FORMAT(1X,'INITIAL EQUIPMENT TEMPERATURES =',F6.1,' DEG F',
   1        1X,'(AMBIENT TEMP)')
490 FORMAT(/,/,/,59X,'CALCULATED DATA')
5   FORMAT(59X,15('-'))
5   FORMAT(/,/,1X,'LIQUID VOLUME IN CYLINDER =',F5.1,' GAL',9X,
   1        'CYLINDER LIQUID TEMPERATURE =',F7.1,' DEG F',3X,
   2        'PERCENT LIQUID FLASHED =',F6.2,' %')
520 FORMAT(1X,'CYLINDER LIQUID DENSITY =',F6.2,' #/CUFT',7X,
   1        'CYLINDER LIQUID VISCOSITY =',F7.4,' #/FT*HR',3X,
   2        'LIQUID LATENT HEAT =',F7.1,' BTU/#MOLE')
530 FORMAT(1X,'LIQUID FILL VELOCITY =',F6.2,' FT/SEC',10X,
```

```
     1        'LIQUID REYNOLDS NUMBER =',F9.1,12X,
     2        'FANNING FRICTION FACTOR =',F10.7)
 540 FORMAT(/,/,/,58X,'CALCULATED RESULTS')
 550 FORMAT(58X,18('-'))
 560 FORMAT(/,/,41X,'PIPE HEATLEAK',9X,'=',F7.3,2X,'# LIQUID',5X,
     1        '(',F4.1,1X,'%)')
 570 FORMAT(41X,'PIPE COOLDOWN',9X,'=',F7.3,2X,'# LIQUID',5X,
     1        '(',F4.1,1X,'%)')
 580 FORMAT(41X,'CYLINDER HEATLEAK',5X,'=',F7.3,2X,'# LIQUID',5X,
     1        '(',F4.1,1X,'%)')
 590 FORMAT(41X,'CYLINDER COOLDOWN',5X,'=',F7.3,2X,'# LIQUID',5X,
     1        '(',F4.1,1X,'%)')
 620 FORMAT(41X,'ISENTHALPIC FLASH',5X,'=',F7.3,2X,'# LIQUID',
     1        5X,'(',F4.1,1X,'%)')
 630 FORMAT(63X,8('-'))
 640 FORMAT(/,41X,'TOTAL CYLINDER LOSSES =',F7.3,2X,'# LIQUID',5X,
     1        '(100.0 %)')
 650 FORMAT(/,/,50X,'TOTAL PERCENT CYLINDER LOSSES =',
     1        F5.1,1X,'%')
 660 FORMAT(/,/,50X,'LIQUID CYLINDER FILL TIME =',F6.2,1X,
     1        'MIN')
 670 FORMAT(/,/,50X,'PUMP HORSEPOWER =',F5.2,1X,
     1'BHP  (EFFICIENCY = 40%)')
9999 STOP
     END
```

APPENDIX B'

Calculating Filling Losses in Pump Transfer

James VanOmmeran

APCT 222-P-USO-3303

©1988 Air Products and Chemical

```
*****************************************
*  LIQUID CYLINDER FILLING LOSSES PROGRAM  *
*          -- PUMPED TRANSFER --           *
*****************************************
```

(DATASET = LCPUMP)

JVO 4/12/84

THIS PROGRAM CALCULATES THE LOSSES ASSOCIATED WITH LIQUID CYLINDER FILLING BY PUMPING. IT HAS PROVISIONS FOR EITHER INSULATED OR UNINSULATEDLIQUID FILL LINES AND EQUIPMENT (FILL LINE, CYLINDER AND PUMP) INITIAL TEMPERATURES OTHER THAN AMBIENT.

THE FOLLOWING ITEMS ARE ASSUMED:

LIQUID FILL LINE — INNER HEAT TRANSFER COEFFICIENT = 500 BTU/HR*SQFT*DEG F

OUTER HEAT TRANSFER COEFFICIENT = 2 BTU/HR*SQFT*DEG F (NATURAL CONVECTION)

PIPE ROUGHNESS = 0.0020 FOR COMMERCIAL COPPER TUBING WITH SOLDER JOINTS

LIQUID CYLINDER — NOMINAL LIQUID CAPACITY = 165 LITERS

DIMENSIONS = 20 IN DIA., 60 IN HT.

STAINLESS STEEL DENSITY = 501 #/CUFT

STAINLESS STEEL HEAT CAPACITY = 0.066 BTU/#*DEG F

SUPER INSULATION DENSITY = 4.78 #/CUFT

SUPER INSULATION HEAT CAPACITY = 0.26 BTU/#*DEG F

THE FOLLOWING ARE DEFAULT VALUES:

LIQUID FILL LINE — COPPER PIPE DENSITY = 556 #/CUFT

COPPER PIPE THERMAL CONDUCTIVITY = 290 BTU/HR*FT*DEG F

COPPER PIPE HEAT CAPACITY = 0.062 BTU/#*DEG F

COPPER PIPE EMISSIVITY CALCULATED FOR OXIDIZED CU AT AVERAGE PIPE TEMPERATURE AND EXPOSED TO AIR (UNINSULATED)

POLYURETHANE FOAM INSULATION DENSITY = 4 #/CUFT

POLYURETHANE FOAM INSULATION THERMAL CONDUCTIVITY = 0.0125 BTU/HR*FT*DEG F

POLYURETHANE FOAM INSULATION HEAT CAPACITY = 0.30 BTU/#*DEG F

WHITE JACKET EMISSIVITY = 0.85 (INSULATED)

LIQUID CYLINDER — LIQUID WEIGHT FOR FULL CYLINDER AS REGULATED BY HM-115 FOR 4L CYLINDERS WITH 235 PSIG PRESSURE RELIEF VALVES OR BY NOMINAL CYLINDER LIQUID VOLUME — WHICHEVER IS LESS

LIN MAX WEIGHT = 224.7 #
LOX MAX WEIGHT = 319.1 #
LAR MAX WEIGHT = 379.6 #

— OR —

LIN MAX VOLUME = 148 LITERS
LOX MAX VOLUME = 148 L
LAR MAX VOLUME = 145 L

CYLINDER NORMAL EVAPORATION RATE
LIN = 2.2 %/DAY
LOX = 1.5 %/DAY
LAR = 1.5 %/DAY

INITIAL TEMPERATURES — INITIAL TEMPERATURES FOR THE LIQUID FILL LINE, CYLINDER AND PUMP (IF REQUIRED) = SPECIFIED AMBIENT TEMPERATURE

PUMP — PUMP EFFICIENCY = 50%

******** INPUT DATA REQUIRED ********

LINE 1: NUMBER OF CASES BEING RUN

LINE 2: LIQUID TYPE (LIN=0, LOX=1, LAR=2), INITIAL TANK PRESSURE (PSIG), FINAL TANK PRESSURE AFTER SUBCOOLING (PSIG), TANK LIQUID HEIGHT (IN), TANK CAPACITY (GAL), INITIAL CYLINDER PRESSURE DURING COOLDOWN (PSIG), FINAL CYLINDER PRESSURE DURING PUMPING (PSIG)

LINE 3: PIPE LENGTH FROM TANK TO PUMP (FT), PIPE LENGTH FROM PUMP TO CYLINDER (FT), PIPE OD (IN), PIPE WALL THICKNESS (IN), PIPE INSULATION THICKNESS (IN), EQUIVALENT VELOCITY HEADS FOR PUMP SUCTION, EQUIVALENT VELOCITY HEADS FOR PUMP EFFLUENT

LINE 4: AMBIENT TEMPERATURE (DEG F), PUMP CAPACITY (GPM), TANK ELEVATION ABOVE PUMP SUCTION (FT), CYLINDER VALVE ELEVATION ABOVE PUMP OUTLET (FT)

******** INPUT DATA TO OVERRIDE DEFAULT VALUES ********

LINE 5: LIQUID FILL WEIGHT (#), PIPE INITIAL TEMPERATURE (DEG F), CYLINDER INITIAL TEMPERATURE (DEG F), PUMP INITIAL TEMPERATURE (DEG F), PIPE DENSITY (#/CUFT), PIPE THERMAL CONDUCTIVITY (BTU/HR*FT*DEG F), PIPE HEAT CAPACITY (BTU/#*DEG F)

LINE 6: PUMP WETTED MASS (#), PUMP EFFICIENCY (%), PUMP HEAT CAPACITY (BTU/#*DEG F), INSULATION DENSITY (#/CF), INSULATION THERMAL CONDUCTIVITY (BTU/HR*FT*DEG F), INSULATION HEAT CAPACITY (BTU/#*DEG F), PIPE EMMISIVITY, CYLINDER NORMAL EVAPORATION RATE (%/DAY)

******** FORTRAN PROGRAM ********

```
      REAL IALM,IAO,ICPRS,IDENS,INSCP,ITHRML,ITPRS,ITTMP,ITVDEN,K,
     1     KWH,LINVOL,LIQHT,LIQMW,LIQTYP,LIQVOL,LIQWT,LOSS,MULTIP,
     2     NEV,NEWVSP

          **** READ INPUT VARIABLES ****

      READ(5,310) NUMBER
      DO 300 I=1,NUMBER
      READ(5,320) LIQTYP,ITPRS,FTPRS,LIQHT,TSIZE,ICPRS,FCPRS
      READ(5,330) PPIPEL,CPIPEL,PIPEOD,PIPETH,PIPEIN,PKF,CKF
      READ(5,340) AMBT,SPGPM,ELEV,CELEV
      READ(5,350) LIQWT,PINTT,CINTT,PMPINT,PDENS,PTHRML,PIPECP
      READ(5,360) PMASS,PMPEFF,PMPCP,IDENS,ITHRML,INSCP,EMISS,NEV

          **** SET DEFAULT VARIABLES ****

      LOSS=0.
      FULL=0.
      TL=0.
      PL=0.
      H0=2.
      H1=500.
      F=0.006
      K=0.001969
      IF(LIQWT .NE. 0.0) GO TO 10
      IF(LIQTYP .EQ. 0.0 .AND. FCPRS .LE. 99.1) LIQWT=224.7
      IF(LIQTYP .EQ. 0.0 .AND. FCPRS .GT. 99.1) LIQVOL=148.
      IF(LIQTYP .EQ. 1.0 .AND. FCPRS .LE. 117.5) LIQWT=319.1
      IF(LIQTYP .EQ. 1.0 .AND. FCPRS .GT. 117.5) LIQVOL=148.
      IF(LIQTYP .EQ. 2.0 .AND. FCPRS .LE. 172.1) LIQWT=379.6
      IF(LIQTYP .EQ. 2.0 .AND. FCPRS .GT. 172.1) LIQVOL=145.
   10 IF(TSIZE .LE. 1700.) TID=5.0
      IF(TSIZE .GT. 1700. .AND. TSIZE .LE. 3400.) TID=5.5
      IF(TSIZE .GT. 3400. .AND. TSIZE .LE. 9400.) TID=7.5
      IF(TSIZE .GT. 9400.) TID=9.5
      IF(PDENS .EQ. 0.0) PDENS=556.
      IF(PTHRML .EQ. 0.0) PTHRML=290.
      IF(PIPECP .EQ. 0.0) PIPECP=0.062
      IF(PMASS .EQ. 0.0) PMASS=20.0
      IF(PMPEFF .EQ. 0.0) PMPEFF=50.0
      IF(PMPCP .EQ. 0.0) PMPCP=0.062
      IF(PIPEIN .EQ. 0.0) GO TO 20
      IF(IDENS .EQ. 0.0) IDENS=4.
      IF(ITHRML .EQ. 0.0) ITHRML=0.0125
```

```
   IF(INSCP .EQ. 0.0) INSCP=0.30
20 IF(EMISS .EQ. 0.0 .AND. PIPEIN .NE. 0.0) EMISS=0.85
   IF(NEV .EQ. 0.0 .AND. LIQTYP .EQ. 0.0) NEV=2.2
   IF(NEV .EQ. 0.0 .AND. LIQTYP .NE. 0.0) NEV=1.5
   IF(LIQTYP .EQ. 1.0) GO TO 30
   IF(LIQTYP .EQ. 2.0) GO TO 40

      **** PHYSICAL PROPERTY COEFFICIENTS FOR LIN ****

   ATSAT=11.692
   BTSAT=-1253.7
   ADENL=52.503
   BDENL=0.1058
   CDENL=-8.7997E-4
   ADENV=-26.62
   BDENV=0.55145
   CDENV=-0.0039128
   DDENV=9.6243E-6
   ALHEAT=1512.7
   BLHEAT=20.077
   CLHEAT=-0.098433
   AVISCL=-6.3648
   BVISCL=1139.2
   CVISCL=-57986.
   ALIQH=-668.426
   BLIQH=4.1241
   CLIQH=0.0320963
   LIQMW=28.013
   GO TO 50

      **** PHYSICAL PROPERTY COEFFICIENTS FOR LOX ****

30 ATSAT=11.972
   BTSAT=-1509.8
   ADENL=78.107
   BDENL=0.058599
   CDENL=-6.5093E-4
   ADENV=-19.657
   BDENV=0.36228
   CDENV=-0.0022984
   DDENV=5.0708E-6
   ALHEAT=2726.0
   BLHEAT=9.8437
   CLHEAT=-0.052835
   AVISCL=-5.4165
   BVISCL=1139.7
   CVISCL=-63282.
   ALIQH=-1675.02
   BLIQH=9.40676
   CLIQH=0.0116992
   LIQMW=31.999
   GO TO 50

      **** PHYSICAL PROPERTY COEFFICIENTS FOR LAR ****

40 ATSAT=11.782
   BTSAT=-1427.5
   ADENL=90.876
   BDENL=0.1187
   CDENL=-9.2913E-4
   ADENV=-22.572
   BDENV=0.42737
   CDENV=-0.0027951
   DDENV=6.3893E-6
   ALHEAT=2546.1
   BLHEAT=10.311
   CLHEAT=-0.055289
   AVISCL=-5.2325
   BVISCL=1074.7
   CVISCL=-57770.
   ALIQH=-1445.211
   BLIQH=6.77447
   CLIQH=0.0133888
   LIQMW=39.948

      **** 2-PHASE FLOW PSUEDO EQUIVALENT VELOCITY HEAD COEF ****
```

```
50 VKF=0.98663
   WKF=0.00267294
   XKF=4.3929E-4
   YKF=-2.8417E-6
   ZKF=6.4257E-9

      **** CALCULATE PHYSICAL PROPERTIES FOR COOLDOWN PHASE ****

   ITTMP=RTSAT/(ALOG(ITPRS+14.7)-ATSAT)
   FTTMP=RTSAT/(ALOG(FTPRS+14.7)-ATSAT)
   TLDEN=ADENL+BDENL*ITTMP+CDENL*(ITTMP**2)
   ITVDEN=ADENV+BDENV*ITTMP+CDENV*(ITTMP**2)+DDENV*(ITTMP**3)
   FTVDEN=ADENV+BDENV*FTTMP+CDENV*(FTTMP**2)+DDENV*(FTTMP**3)
   TLENT=ALIQH+BLIQH*ITTMP+CLIQH*(ITTMP**2)
   STHEAD=TLDEN*LIQHT/12./144.
   BOTTPR=FTPRS+STHEAD
   PPRS=BOTTPR-(PKF/(PKF+CKF))*(BOTTPR-ICPRS)
   PTMP=RTSAT/(ALOG(PPRS+14.7)-ATSAT)
   PLDEN=ADENL+BDENL*PTMP+CDENL*(PTMP**2)
   PLH=ALHEAT+BLHEAT*PTMP+CLHEAT*(PTMP**2)
   PLENT=ALIQH+BLIQH*PTMP+CLIQH*(PTMP**2)
   PLVIS=EXP(AVISCL+BVISCL/PTMP+CVISCL/(PTMP**2))
   PDELPR=BOTTPR-PPRS
   PTMP=PTMP-459.7
   MULTIP=VKF+WKF*PDELPR+XKF*(PDELPR**2)+YKF*(PDELPR**3)+ZKF*
  1        (PDELPR**4)
   PKF=PKF*MULTIP
   TOTKF=PKF+CKF

      **** CALCULATE SUBCOOLING OF STORAGE TANK ****

   SUBDP=FTPRS-ITPRS
   TVSPC=TSIZE/7.481-3.1416*(TID/2.)**2*LIQHT/12.
   DUMMY=TVSPC
60 SCLOSS=DUMMY*(FTVDEN-ITVDEN)
   LINVOL=SCLOSS/TLDEN
   NEWVSP=TVSPC+LINVOL
   SCERR=ABS(DUMMY-NEWVSP)
   IF(SCERR .LE. 0.01) GO TO 70
   DUMMY=NEWVSP
   GO TO 60
70 IF(PIPEIN .NE. 0.0) GO TO 90

      **** CALCULATE PIPE CONVECTION AND RADIATION HEATLEAK ****
                 **** TO PUMP -- UNINSULATED ****

   IF(EMISS .NE. 0.0) GO TO 80
   AVPTMP=(AMBT+459.7)*0.25+(PTMP+459.7)*0.75
   EMISS=0.76473-7.1438E-4*AVPTMP+3.3012E-7*(AVPTMP**2)
80 PAO=3.1416*(PIPEOD/12.)*PPIPEL
   PIPEID=PIPEOD-2.*PIPETH
   PAI=3.1416*(PIPEID/12.)*PPIPEL
   PALM=(PAO-PAI)/ALOG(PAO/PAI)
   CONV=(AMBT-PTMP)/(1/HI/PAI+PIPETH/(12.*PTHRML*PALM)+1/HO/PAO)
   TSURF=AMBT-CONV/(HO*PAO)
   RAD=.1714E-8*EMISS*PAO*((AMBT+459.7)**4-(TSURF+459.7)**4)
   PPHTLK=CONV+RAD

      **** CALCULATE PIPE COOLDOWN TO PUMP ****

   IF(PINTT .EQ. 0.0) PINTT=AMBT
   PPIPCD=(PDENS*3.1416/4.*((PIPEOD/12.)**2-(PIPEID/12.)**2)
  1        *PIPECP*PPIPEL*(PINTT-PTMP))*1.5
   GO TO 120

      **** CALCULATE PIPE CONVECTION AND RADIATION HEATLEAK ****
                 **** TO PUMP -- INSULATED ****

90 PAO=3.1416*(PIPEOD/12.)*PPIPEL
   PIPEID=PIPEOD-2.*PIPETH
   PAI=3.1416*(PIPEID/12.)*PPIPEL
   PALM=(PAO-PAI)/ALOG(PAO/PAI)
   IAO=3.1416*((2.*PIPEIN+PIPEOD)/12.)*PPIPEL
   IALM=(IAO-PAO)/ALOG(IAO/PAO)
   CONV=(AMBT-PTMP)/(1/HI/PAI+PIPETH/(12.*PTHRML*PALM)+
  1     PIPEIN/(12.*ITHRML*IALM)+1/HO/IAO)
```

```
      TSURF=AMBT-CONV/(HO*IAO)
      RAD=.1714E-8*EMISS*IAO*((AMBT+459.7)**4-(TSURF+459.7)**4)
      PPHTLK=CONV+RAD

          **** CALCULATE PIPE AND INSULATION COOLDOWN TO PUMP ****

      IF(PINTT .NE. 0.0) GO TO 100
      PINTT=AMBT
      PINTLM=AMBT
      GO TO 110
100   PINTLM=(TSURF-PINTT)/ALOG((TSURF+459.7)/(PINTT+459.7))-459.7
110   PITLM=(TSURF-PTMP)/ALOG((TSURF+459.7)/(PTMP+459.7))-459.7
      PPIPCD=PDENS*3.1416/4.*((PIPEOD/12.)**2-(PIPEID/12.)**2)*PIPECP
     1        *PPIPEL*(PINTT-PTMP)+IDENS*3.1416/4.*(((2.*PIPEIN
     2        +PIPEOD)/12.)**2-(PIPEOD/12.)**2)*INSCP*PPIPEL*(PINTLM
     3        -PITLM)

          **** CALCULATE PUMP COOLDOWN ****

120   IF(PMPINT .EQ. 0.0) PMPINT=AMBT
      PMPCLD=PMASS*PMPCP*(PMPINT-PTMP)
      CDSURL=PPIPCD+PMPCLD
      CDLVOL=CDSURL/PLDEN

          **** CALCULATE JOULE-THOMPSON FLASHING LOSS ****

      FLASH=(PLENT-TLENT)/PLH
      FSHPCT=FLASH*100.

          **** GUESS INITIAL FLOW IS 5 GPM ****

      PSHEAD=PLDEN*ELEV/144.
      VEL=5.*144./7.481/60./(3.1416*(PIPEID/2.)**2)

          **** ITERATION FOR FRICTION FACTOR ****

130   CDRE=PLDEN*VEL*PIPEID/12./(PLVIS/3600.)
140   CDFF=(1./(-4.*ALOG10(K/PIPEID+4.67/CDRE/(F**.5))+2.28))**2
      FERR=ABS(CDFF-F)
      IF(FERR .LT. 0.00001) GO TO 150
      F=CDFF
      GO TO 140

          **** ITERATION FOR LIQUID VELOCITY DURING COOLDOWN ****

150   CDLVEL=((PDELPR+PSHEAD)*144./(2.*CDFF*PLDEN*PPIPEL/(PIPEID/12.)
     1        /32.2+PLDEN*PKF/2./32.2))**.5
      VERR=ABS(CDLVEL-VEL)
      IF(VERR .LT. 0.02) GO TO 160
      VEL=CDLVEL
      GO TO 130
160   GPM=CDLVEL*60.*7.481*3.1416/4.*(PIPEID/12.)**2

          **** CALCULATE PUMP INLET COOLDOWN TIME ****

170   CDTIME=CDLVOL*7.481/GPM

          **** CALCULATE TOTAL PUMP COOLDOWN FILLING LOSSES ****

      CDLOSS=((PPHTLK)*CDTIME/60.+PPIPCD+PMPCLD)/PLH*LIOMW
      CDFSH=CDLOSS*FLASH
      TCDLOS=CDLOSS+CDFSH+SCLOSS

          **** CALCULATE ERROR FOR PUMP COOLDOWN LOSSES ITERATION ****

      ERROR=ABS(TCDLOS-LOSS)
      IF(ERROR .LE. 0.05) GO TO 180
      LOSS=TCDLOS
      CDLVOL=(TCDLOS-SCLOSS)/PLDEN
      GO TO 170

          **** CALCULATE PHYSICAL PROPERTIES FOR PUMPING PHASE ****

180   CTMP=RTSAT/(ALOG(FCPRS+14.7)-ATSAT)
      CLDEN=ADENL+BDENL*CTMP+CDENL*(CTMP**2)
      CLH=ALHEAT+BLHEAT*CTMP+CLHEAT*(CTMP**2)
```

```
      CLVIS=EXP(AVISCL+BVISCL/CTMP+CVISCL/(CTMP**2))
      CTMP=CTMP-459.7
      IF(PIPEIN .NE. 0.0) GO TO 200

          **** CALCULATE PIPE CONVECTION AND RADIATION HEATLEAK ****
                      **** TO CYLINDER -- UNINSULATED ****

      IF(EMISS .NE. 0.0) GO TO 190
      AVPTMP=(AMBT+459.7)*0.25+(CTMP+459.7)*0.75
      EMISS=0.76473-7.1438E-4*AVPTMP+3.3012E-7*(AVPTMP**2)
  190 PAO=3.1416*(PIPEOD/12.)*CPIPEL
      PAI=3.1416*(PIPEID/12.)*CPIPEL
      PALM=(PAO-PAI)/ALOG(PAO/PAI)
      CONV=(AMBT-CTMP)/(1/HI/PAI+PIPETH/(12.*PTHRML*PALM)+1/HO/PAO)
      TSURF=AMBT-CONV/(HO*PAO)
      RAD=.1714E-8*EMISS*PAO*((AMBT+459.7)**4-(TSURF+459.7)**4)
      CPHTLK=CONV+RAD

          **** CALCULATE PIPE COOLDOWN TO CYLINDER ****

      IF(PINTT .EQ. 0.0) PINTT=AMBT
      CPIPCD=(PDENS*3.1416/4.*((PIPEOD/12.)**2-(PIPEID/12.)**2)
     1        *PIPECP*CPIPEL*(PINTT-CTMP))*1.5
      GO TO 230

          **** CALCULATE PIPE CONVECTION AND RADIATION HEATLEAK ****
                      **** TO CYLINDER -- INSULATED ****

  200 PAO=3.1416*(PIPEOD/12.)*CPIPEL
      PAI=3.1416*(PIPEID/12.)*CPIPEL
      PALM=(PAO-PAI)/ALOG(PAO/PAI)
      IAO=3.1416*((2.*PIPEIN+PIPEOD)/12.)*CPIPEL
      IALM=(IAO-PAO)/ALOG(IAO/PAO)
      CONV=(AMBT-CTMP)/(1/HI/PAI+PIPETH/(12.*PTHRML*PALM)+
     1      PIPEIN/(12.*THRML*IALM)+1/HO/IAO)
      TSURF=AMBT-CONV/(HO*IAO)
      RAD=.1714E-8*EMISS*IAO*((AMBT+459.7)**4-(TSURF+459.7)**4)
      CPHTLK=CONV+RAD

          **** CALCULATE PIPE AND INSULATION COOLDOWN TO CYLINDER *****

      IF(PINTT .NE. 0.0) GO TO 210
      PINTT=AMBT
      PINTLM=AMBT
      GO TO 220
  210 PINTLM=(TSURF-PINTT)/ALOG((TSURF+459.7)/(PINTT+459.7))-459.7
  220 PITLM=(TSURF-CTMP)/ALOG((TSURF+459.7)/(CTMP+459.7))-459.7
      CPIPCD=PDENS*3.1416/4.*((PIPEOD/12.)**2-(PIPEID/12.)**2)*PIPECP
     1        *CPIPEL*(PINTT-CTMP)+IDENS*3.1416/4.*(((2.*PIPEIN
     2        +PIPEOD)/12.)**2-(PIPEOD/12.)**2)*INSCP*CPIPEL*(PINTLM
     3        -PITLM)

          **** CALCULATE CYLINDER HEATLEAK ****

  230 IF(LIQWT .NE. 0.0) GO TO 240
      LIQVOL=LIQVOL/28.31685
      LIQWT=LIQVOL*CLDEN
      FULL=1.0
      GO TO 250
  240 IF(LIQTYP .EQ. 0.0 .AND. LIQWT .GE. 224.7) FULL=1.0
      IF(LIQTYP .EQ. 1.0 .AND. LIQWT .GE. 319.1) FULL=1.0
      IF(LIQTYP .EQ. 2.0 .AND. LIQWT .GE. 379.6) FULL=1.0
      LIQVOL=LIQWT/CLDEN
  250 GALLON=LIQVOL*7.481
      CHTLK=0.5*(NEV/100.)*LIQWT*(1./LIQMW)*CLH*(1./24.)

          **** CALCULATE CYLINDER AND INSULATION COOLDOWN ****

      IF(CINTT .EQ. 0.0) CINTT=AMBT
      CCOOLD=(501.*3.1416*0.04787*0.066*(CINTT-CTMP)+4.78*3.1416
     1        *0.5068*0.26*36.7/100.*(CINTT-CTMP))*0.65

          **** CALCULATE CYLINDER FILL TIME FOR PUMPING ****

      PLVEL=SPGPM/60./7.481/(3.1416/4.*(PIPEID/12.)**2)
  260 PTIME=LIQVOL*7.481/SPGPM
```

```
      **** CALULATE PUMP ENERGY CONSUMPTION ****

      PRE=CLDEN*PLVEL*(PIPEID/12.)/(CLVIS/3600.)
      F=0.006
270   PFF=(1./(-4.*ALOG10(K/PIPEID+4.67/PRE/(F**.5))+2.28))**2
      PFERR=ABS(PFF-F)
      IF(PFERR .LT. 0.00001) GO TO 280
      F=PFF
      GO TO 270
280   PMPDP=((2*PFF*CLDEN*(PLVEL**2)*CPIPEL/(PIPEID/12.)/32.2
     1       *CLDEN*(PLVEL**2)*CKE/2./32.2)+CELEV*CLDEN)/144.
      POUTPR=FCPRS+PMPDP
      BHP=(POUTPR-PPRS)*SPGPM/1713./(PMPEFF/100.)
      KWH=BHP*0.7547/0.95*PTIME/60.

      **** CALCULATE TOTAL CYLINDER FILLING PUMPING LOSSES ****

      PMPLOS=((CPHTLK+CHTLK)*PTIME/60.+CPIPCD+CCOOLD)/CLH*LIQMW

      **** CALCULATE ERROR FOR PUMPING FILLING LOSSES ****

      PMPERR=ABS(PMPLOS-PL)
      IF(PMPERR .LE. 0.05) GO TO 290
      PL=PMPLOS
      LIQVOL=(LIQWT+PMPLOS)/CLDEN
      GO TO 260

      **** CALCULATE OVERALL PUMPED TRANSFER FILLING LOSS ****

290   TOTLOS=TCDLOS+PMPLOS

      **** CALCULATE OUTPUT PERCENTAGE LOSSES VARIABLES ****

      PPHTLK=PPHTLK*CDTIME/60./PLH*LIQMW
      CPHTLK=CPHTLK*PTIME/60./CLH*LIQMW
      CHTLK=CHTLK*PTIME/60./CLH*LIQMW
      PPIPCD=PPIPCD/PLH*LIQMW
      CPIPCD=CPIPCD/CLH*LIQMW
      CCOOLD=CCOOLD/CLH*LIQMW
      PMPCLD=PMPCLD/PLH*LIQMW
      P1=SCLOSS/TOTLOS*100.
      P2=PPHTLK/TOTLOS*100.
      P3=PPIPCD/TOTLOS*100.
      P4=PMPCLD/TOTLOS*100.
      P5=CDFSH/TOTLOS*100.
      P6=CPHTLK/TOTLOS*100.
      P7=CPIPCD/TOTLOS*100.
      P8=CCOOLD/TOTLOS*100.
      P9=CHTLK/TOTLOS*100.
      CDPRCT=TCDLOS/TOTLOS*100.
      PPRCT=PMPLOS/TOTLOS*100.
      TOTPER=TOTLOS/LIQWT*100.

      **** PRINT OUTPUT ****

      WRITE(6,370)
      WRITE(6,380)
      WRITE(6,390)
      WRITE(6,400)
      WRITE(6,410)
      WRITE(6,420) I
      WRITE(6,430)
      WRITE(6,440)
      WRITE(6,450)
      IF(LIQTYP .EQ. 0.0) WRITE(6,460) PPIPEL,CPIPEL
      IF(LIQTYP .EQ. 1.0) WRITE(6,470) PPIPEL,CPIPEL
      IF(LIQTYP .EQ. 2.0) WRITE(6,480) PPIPEL,CPIPEL
      IF(PIPEIN .EQ. 0.0) WRITE(6,490) PIPEOD,PIPETH
      IF(PIPEIN .NE. 0.0) WRITE(6,500) PIPEOD,PIPETH,PIPEIN
      WRITE(6,510) SUBDP,FCPRS,AMBT
      IF(FULL .EQ. 0.0) WRITE(6,520) LIQWT,TSIZE,SPGPM
      IF(FULL .NE. 0.0) WRITE(6,530) LIQWT,TSIZE,SPGPM
      IF(PINTT .NE. AMBT .OR. CINTT .NE. AMBT .OR. PMPINT .NE.
     1   AMBT) WRITE(6,540) PINTT,CINTT,PMPINT
      IF(PINTT .EQ. AMBT .AND. CINTT .EQ. AMBT .AND. PMPINT .EQ.
     1   AMBT) WRITE(6,550) AMBT
      WRITE(6,560) TOTKE
```

```
      WRITE(6,570)
      WRITE(6,580)
      WRITE(6,590) GALLON,PTMP,PLDEN
      WRITE(6,600) PLVIS,PLH,FSHPCT
      WRITE(6,610) CDLVEL,CDRE,CDFF
      WRITE(6,620) CTMP,CLDEN,CLVIS
      WRITE(6,630) CLH,PLVEL,PRE
      WRITE(6,640) PFF
      WRITE(6,650)
      WRITE(6,660)
      WRITE(6,670)
      WRITE(6,680)
      WRITE(6,690) SCLOSS,P1,CPHTLK,P6
      WRITE(6,700) PPHTLK,P2,CHTLK,P9
      WRITE(6,710) PPIPCD,P3,CCOOLD,P8
      WRITE(6,720) PMPCLD,P4,CPIPCD,P7
      WRITE(6,730) CDFSH,P5
      WRITE(6,740)
      WRITE(6,750) TCDLOS,CDPRCT,PMPLOS,PPRCT
      WRITE(6,760) TOTLOS,TOTPER
      WRITE(6,770) CDTIME
      WRITE(6,780) PTIME
      WRITE(6,790) KWH,PMPEFF
  300 CONTINUE

          **** I/O FORMAT STATEMENTS ****

  310 FORMAT(4X,I2)
  320 FORMAT(2X,7(F9.4))
  330 FORMAT(2X,7(F9.4))
  340 FORMAT(2X,4(F9.4))
  350 FORMAT(2X,7(F9.4))
  360 FORMAT(2X,8(F9.4))
  370 FORMAT('1',/,39X,54('*'))
  380 FORMAT(39X,5('*'),3X,'LIQUID CYLINDER FILLING LOSSES RESULTS',
     1        3X,5('*'))
  390 FORMAT(39X,5('*'),13X,'- PUMPED TRANSFER -',12X,5('*'))
  400 FORMAT(39X,54('*'))
  410 FORMAT(/,59X,17('-'))
  420 FORMAT(59X,'\ CASE RUN =',I3,' \')
  430 FORMAT(59X,17('-'))
  440 FORMAT(/,/,62X,'INPUT DATA')
  450 FORMAT(62X,10('-'))
  460 FORMAT(/,/,1X,'LIN CYLINDER FILL PERFORMED',18X,
     1        'PIPE LENGTH TO PUMP =',F6.1,' FT',15X,
     2        'PIPE LENGTH TO CYLINDER =',F6.1,' FT')
  470 FORMAT(/,/,1X,'LOX CYLINDER FILL PERFORMED',18X,
     1        'PIPE LENGTH TO PUMP =',F6.1,' FT',15X,
     2        'PIPE LENGTH TO CYLINDER =',F6.1,' FT')
  480 FORMAT(/,/,1X,'LAR CYLINDER FILL PERFORMED',18X,
     1        'PIPE LENGTH TO PUMP =',F6.1,' FT',15X,
     2        'PIPE LENGTH TO CYLINDER =',F6.1,' FT')
  490 FORMAT(1X,'PIPE OD =',F6.3,' IN',27X,'PIPE WALL THICKNESS =',
     1        F6.3,' IN',15X,'NO PIPE INSULATION')
  500 FORMAT(1X,'PIPE OD =',F6.3,' IN',27X,'PIPE WALL THICKNESS =',
     1        F6.3,' IN',15X,'INSULATION THICKNESS =',F5.2,' IN')
  510 FORMAT(1X,'TANK SUBCOOLING =',F5.1,' PSI',19X,
     1        'CYLINDER FILL PRESSURE =',F6.1,' PSIG',10X,
     2        'AMBIENT TEMPERATURE =',F6.1,' DEG F')
  520 FORMAT(1X,'CYLINDER LIQUID WEIGHT =',F6.1,' #',13X,
     1        'STORAGE TANK SIZE =',F7.0,' GAL',15X,'PUMP CAPACITY =',
     2        F5.1,' GPM')
  530 FORMAT(1X,'CYLINDER LIQUID WEIGHT =',F6.1,' #  (FULL)',5X,
     1        'STORAGE TANK SIZE =',F7.0,' GAL',15X,'PUMP CAPACITY =',
     2        F5.1,' GPM')
  540 FORMAT(1X,'INITIAL PIPE TEMPERATURE =',F7.1,' DEG F',6X,
     1        'INITIAL CYLINDER TEMPERATURE =',F7.1,' DEG F',2X,
     2        'INITIAL PUMP TEMPERATURE =',F7.1,' DEG F')
  550 FORMAT(1X,'INITIAL EQUIPMENT TEMPERATURES =',F6.1,' DEG F',
     1        1X,'(AMBIENT TEMP)')
  560 FORMAT(1X,'FILL LINE EQUIVALENT VELOCITY HEADS =',F6.1)
  570 FORMAT(/,/,59X,'CALCULATED DATA')
  580 FORMAT(59X,15('-'))
  590 FORMAT(/,/,1X,'LIQUID VOLUME IN CYLINDER =',F5.1,' GAL',9X,
     1        'PUMP LIQUID TEMPERATURE =',F7.1,' DEG F',7X,
     2        'PUMP LIQUID DENSITY =',F6.2,' #/CUFT')
```

```
600 FORMAT(1X,'PUMP LIQUID VISCOSITY =',F7.4,' #/FT*HR',7X,
    1        'PUMP LIQUID LATENT HEAT =',F7.1,' BTU/#MOLE',3X,
    2        'LIQUID FLASH DURING COOLDOWN =',F6.2,' %')
610 FORMAT(1X,'LIQUID VELOCITY DURING C/D =',F6.2,' FT/SEC',4X,
    1        'REYNOLDS NUMBER FOR C/D =',F9.1,11X,
    2        'C/D FANNING FRICTION FACTOR =',F10.7)
620 FORMAT(1X,'CYLINDER LIQUID TEMPERATURE =',F7.1,' DEG F',3X,
    1        'CYLINDER LIQUID DENSITY =',F6.2,' #/CUFT',7X,
    2        'CYLINDER LIQUID VISCOSITY =',F7.4,' #/FT*HR')
630 FORMAT(1X,'CYL LIQUID LATENT HEAT =',F7.1,' BTU/#MOLE',4X,
    1        'LIQ VELOCITY DURING PUMPING =',F6.2,' FT/SEC',3X,
    2        'REYNOLDS NUMBER FOR PUMPING =',F9.1)
640 FORMAT(1X,'PUMP FANNING FRICTION FACTOR =',F10.7)
650 FORMAT(/,/,58X,'CALCULATED RESULTS')
660 FORMAT(58X,18('-'))
670 FORMAT(/,24X,'COOLDOWN PHASE',54X,'PUMPING PHASE')
680 FORMAT(24X,14('-'),54X,13('-'))
690 FORMAT(/,9X,'TANK SUBCOOLING',7X,'=',F7.3,2X,'# LIQUID',5X,
    1        '(',F4.1,' %)',10X,'PIPE HEATLEAK',9X,'=',F7.3,2X,
    2        '# LIQUID',5X,'(',F4.1,' %)')
700 FORMAT(9X,'PIPE HEATLEAK',9X,'=',F7.3,2X,'# LIQUID',5X,
    1        '(',F4.1,1X,'%)',10X,'CYLINDER HEATLEAK',5X,'=',F7.3,
    2        2X,'# LIQUID',5X,'(',F4.1,' %)')
710 FORMAT(9X,'PIPE COOLDOWN',9X,'=',F7.3,2X,'# LIQUID',5X,
    1        '(',F4.1,1X,'%)',10X,'CYLINDER COOLDOWN',5X,'=',F7.3,
    2        2X,'# LIQUID',5X,'(',F4.1,' %)')
720 FORMAT(9X,'PUMP COOLDOWN',9X,'=',F7.3,2X,'# LIQUID',5X,
    1        '(',F4.1,1X,'%)',10X,'PIPE COOLDOWN',9X,'=',F7.3,2X,
    2        '# LIQUID',5X,'(',F4.1,' %)')
730 FORMAT(9X,'ISENTHALPIC FLASH',5X,'=',F7.3,2X,'# LIQUID',5X,
    1        '(',F4.1,1X,'%)')
740 FORMAT(31X,8('-'),55X,8('-'))
750 FORMAT(/,9X,'COOLDOWN FILLING LOSS =',F7.3,2X,'# LIQUID',5X,
    1        '(',F4.1,' %)',10X,'PUMPING FILLING LOSS  =',F7.3,2X,
    2        '# LIQUID',5X,'(',F4.1,' %)')
760 FORMAT(/,/,40X,'TOTAL LIQUID CYLINDER FILLING LOSS =',F7.3,2X,
    1        '# LIQUID',3X,'(',F5.1,' %)')
770 FORMAT(/,/,56X,'COOLDOWN TIME =',F6.2,' MIN')
780 FORMAT(/,56X,'PUMPING TIME  =',F6.2,' MIN')
790 FORMAT(/,/,43X,'PUMP ENERGY CONSUMPTION =',F5.2,' KWH',3X,
    1        '(EFFICIENCY =',F4.0,' %)')
9999 STOP
     END
```

APPENDIX C

©1988 Air Products and Chemicals, Inc.

```
byte: BEENUM, PB_STAGE, PU_STAGE
integer: i, PT20, TC40, TC56, PT66, FCV68, SCALE94, DPS48, ICV28, MS36
integer: HORN, PULL, BEBLITE
string: BESP$[1]

Procedure BEEP
'  This routine sounds the horn for routine operator acknowledgement.'
external: DIGOUT, HORN
 10 DIGOUT(HORN,1)
 20 wait(3) : 'Sound Horn For 3 Seconds'
 30 DIGOUT(HORN,0) : EXIT
EXIT 1

Real Function ANALIN
'  This function reads analog input channels (transducers, thermocouples, etc.).'
integer arg: LABEL
 10 on LABEL goto 100, 200, 200, 100
100 result=(ain(LABEL)/5)*300 : 'Conversion For 0-300 Psig Pressure Transducer'
200 result=((ain(LABEL)/5)*470)+140 : 'Conversion For 140-610 Thermocouple'
EXIT 1
```

```
Procedure ANALOUT
' This routine sends analog output signals (flow control valves, etc.).'
integer arg: LABEL, VALUE
 10 on LABEL-4 goto 100
100 aot(LABEL,(VALUE/100)*5) : EXIT : 'Sends Analog Out 0-5 VDC Signals'
EXIT 1

Integer Function DIGIN
' This function reads digital input channels (scale, differential pressure switch, etc.).'
integer arg: LABEL
 10 result=din(LABEL,LABEL,LABEL) : EXIT
EXIT 1

Procedure DIGOUT
' This routine sends digital output signals (solenoid valves, motor starters, lights, etc.).'
integer arg: LABEL, BIT
 10 dot(LABEL,LABEL-8,LABEL-8)=BIT : EXIT
EXIT 1

Procedure ALARM
' This routine Handles alarm conditions for both pressure and pumped'
' transfer liquid cylinder filling.'
external: ANALOUT, DIGOUT, BEELITE, EBENUM, FCV68, HOEN, MS36, PE_STAGE
external: PU_STAGE, ICV28
 10 DIGOUT(HOEN,1) : DIGOUT(EBELITE,1)
 20 print"*** AN ALARM CONDITION HAS OCCURRED DURING THE LIQUID CYLINDER FILL ! ***"
 30 on EBENUM goto 100, 110, 120, 130, 140, 150
100 print"The Cylinder Vent Gas Failed To Start Cooling During A Fast Cooldown."
103 print"Check For Proper Operation Of ICV28 Or Connection Of The Cylinder."
105 DIGOUT(ICV28,0) : ANALOUT(FCV68,0) : goto 300
110 print"The Cylinder Vent Gas Failed To Start Cooling During A Slow Cooldown."
113 print"Check For Proper Operation Of ICV28 Or Connection Of The Cylinder."
115 DIGOUT(ICV28,0) : ANALOUT(FCV68,0) : goto 300
120 print"Cylinder Taking Too Long To Pressure Fill, Check For No Obstructions"
123 print"In The Fill Line And Proper Connection Of The Cylinder."
125 DIGOUT(ICV28,0) : ANALOUT(FCV68,0) : goto 300
130 print"Liquid Sensed In Cylinder Vent Line, Cylinder Is Overfilled !"
133 print"Check For Proper Selection Of Final Liquid Weight Desired."
135 DIGOUT(ICV28,0) : ANALOUT(FCV68,0) : goto 300
140 print"The Liquid Pump Failed To Start Cooling During A Fast Cooldown."
143 print"Check For Proper Operation Of ICV28 And No Fill Line Leaks."
145 DIGOUT(ICV28,0) : ANALOUT(FCV68,0) : goto 300
150 print"The Liquid Pump Failed To Reach Cooldown During A Fast Cooldown."
153 print"Check For Proper Operation Of ICV28 And No Fill Line Leaks."
155 DIGOUT(ICV28,0) : ANALOUT(FCV68,0) : goto 300
160 print"The Liquid Pump Failed To Start Cooling During A Slow Cooldown."
163 print"Check For Proper Operation Of ICV28 And No Fill Line Leaks."
165 DIGOUT(ICV28,0) : ANALOUT(FCV68,0) : goto 300
170 print"The Liquid Pump Failed To Reach Cooldown During A Slow Cooldown."
173 print"Check For Proper Operation Of ICV28 And No Fill Line Leaks."
175 DIGOUT(ICV28,0) : ANALOUT(FCV68,0) : goto 300
180 print"Cylinder Taking Too Long To Pump Fill, Check For Proper Operation"
183 print"Of The Pump And Proper Connection Of The Cylinder."
185 DIGOUT(MS36,0) : DIGOUT(ICV28,0) : ANALOUT(FCV68,0) : goto 400
190 print"Liquid Sensed In Cylinder Vent Line, Cylinder Is Overfilled !"
193 print"Check For Proper Selection Of Final Liquid Weight Desired."
195 DIGOUT(MS36,0) : DIGOUT(ICV28,0) : ANALOUT(FCV68,0) : goto 400
200 print"Liquid Pump Has Exceeded Maximum Cavitation Count As Sensed"
203 print"By Differential Pressure Switch, Inspect Pump Operation."
205 DIGOUT(MS36,0) : DIGOUT(ICV28,0) : ANALOUT(FCV68,0) : goto 400
210 print"Liquid Pump Has Exceeded Maximum Cavitation Count As Sensed"
213 print"By Pump Outlet Temperature Warning, Inspect Pump Operation."
215 DIGOUT(MS36,0) : DIGOUT(ICV28,0) : ANALOUT(FCV68,0) : goto 400
```

```
300 print"Process Conditions Set To Safe Conditons ..."
310 PR_STAGE=0 : DIGOUT(HORN,0) : DIGOUT(ERRLITE,0) : EXIT
400 print"Process Conditions Set To Safe Conditons ..."
410 PU_STAGE=0 : DIGOUT(HORN,0) : DIGOUT(ERRLITE,0) : EXIT
EXIT 1

Procedure PR_FASTCOOL
'  Pressure Transfer -- This procedure peforms a fast cylinder cooldown'
'                       if requested or continues slow cooldown if not'
'                       requested.'
real: CYL_T_INIT, START_TIME
external: ALARM, ANALIN, ANALOUT, DIGOUT, ERRNUM, FCV68, PR_STAGE, RESP$
external: TC56, ICV28
 10 input"Do You Want A Fast Cylinder Cooldown (Y/N) ?";RESP$
 20 if (RESP$<>"Y" or RESP$<>"N") goto 10
 30 if RESP$="Y" clear(RESP$) : goto 100 else clear(RESP$) : PR_STAGE=2 : EXIT
100 ANALOUT(FCV68,100) : 'Set Flow Control Valve #68 To 100% Open'
110 CYL_T_INIT=ANALIN(TC56) : 'Store Initial Temperature Of Gas Exiting Cylinder'
120 DIGOUT(ICV28,1) : 'Open Solenoid Fill Valve #28'
130 START_TIME=timer
140 if (ANALIN(TC56)<CYL_T_INIT-20) goto 200 : 'Checks If Cooldown Started'
150 if (timer-START_TIME)>30 ERRNUM=1 : ALARM else goto 140
200 if ANALIN(TC56)<-150 PR_STAGE=3 EXIT else goto 200 : 'Exit When Cooldown At -150 F'
EXIT 1

Procedure PR_SLOWCOOL
'  Pressure Transfer -- This procedure performs a slow cylinder cooldown'
'                       by calculating the optimum differential pressure'
'                       for the initial conditions.'
real: CYL_P, CYL_T_INIT, DELTA_P_CALC, P_ERR, PCT, START_TIME, TANK_P_INIT
external: ALARM, ANALIN, ANALOUT, DIGOUT, ERRNUM, FCV68, PR_STAGE, PT20
external: PT66, TC56, ICV28
 10 PCT=50
 20 ANALOUT(FCV68,PCT) : 'Set Flow Control Valve #68 To 50% Open To Start'
 30 CYL_T_INIT=ANALIN(TC56) : 'Store Initial Temperature Of Gas Exiting Cylinder'
 40 DIGOUT(ICV28,1) : 'Open Solenoid Fill Valve #28'
 50 TANK_P_INIT=ANALIN(PT20) : CYL_P=ANALIN(PT66) : 'Store Initial Tank And Cylinder Pressure'
 60 DELTA_P_CALC=0.16905+0.41357*CYL_P-0.0031905*CYL_P^2+9.6e-6*CYL_P^3 : 'Calculate Optimal Differential Pressure'
 70 P_ERR=(ANALIN(PT20)-CYL_P)-DELTA_P_CALC
 80 if ABS(P_ERR)<1 goto 200
 90 PCT=PCT*(1+(P_ERR/DELTA_P_CALC))
100 ANALOUT(FCV68,PCT) : goto 70 : 'Set Flow Control Valve #68 To Calculated Percent'
200 START_TIME=timer
210 if (ANALIN(TC56)<CYL_T_INIT-20) PR_STAGE=3 : EXIT : 'Checks If Cooldown Started'
220 if (timer-START_TIME)>60 ERRNUM=2 : ALARM else goto 210
EXIT 1

Procedure PR_OPTIMUM
'  Pressure Transfer -- This procedure is the main routine for calculating'
'                       the optimum differential filling pressure for'
'                       the cylinder filling sequence.'
real: CYL_P, DELTA_P_CALC, P_ERR, PCT, TANK_P
external: ANALIN, ANALOUT, FCV68, PR_STAGE, PT20, PT66
 10 TANK_P=ANALIN(PT20) : CYL_P=ANALIN(PT66) : 'Store Current Tank And Cylinder Pressure'
 20 DELTA_P_CALC=0.16905+0.41357*CYL_P-0.0031905*CYL_P^2+9.6e-6*CYL_P^3 : 'Calculate Optimal Differential Pressure'
 30 P_ERR=(ANALIN(PT20)-CYL_P)-DELTA_P_CALC
 40 if ABS(P_ERR)<1 goto 100
 50 PCT=PCT*(1+(P_ERR/DELTA_P_CALC))
 60 ANALOUT(FCV68,PCT) : goto 10 : 'Set Flow Control Valve #68 To Calculated Percent'
100 PR_STAGE=4 : EXIT
EXIT 1
```

```
Procedure PR_FILL
'  Pressure Transfer -- This procedure is the main shutdown routine for'
'                       checking for alarm conditions or for a full'
'                       signal from the scale.  The optimum differential'
'                       filling pressure is recalculated and adjusted'
'                       every time through the loop.'
byte: ONCETHRU
real: LIQ_T_CALC, START_TIME
external: ALARM, ANALIN, DIGIN, BEENUM, PR_STAGE, PT66, SCALE94, TC56
 10 if ONCETHRU goto 30
 20 START_TIME=timer : ONCETHRU=1
 30 LIQ_T_CALC=-1248.1/(log(ANALIN(PT66))-11.664) : 'Calculates Liquid N2 Temperature At Cylinder Pressure In Deg R'
 40 if (timer-START_TIME)>1200 BEENUM=3 : ONCETHRU=0 : ALARM : EXIT : 'Checks If Fill Takes Longer Than 20 Min.'
 50 if ANALIN(TC56)<LIQ_T_CALC+5 BEENUM=4 : ONCETHRU=0 : ALARM : EXIT : 'Checks If Liquid Venting From Cylinder'
 60 if DIGIN(SCALE94) PR_STAGE=5 : ONCETHRU=0 : EXIT : 'Continues To Shutdown Fill When Cylinder Full'
 70 PR_STAGE=3 : EXIT : 'Fill Proceeding Fine So Readjust Optimum Pressure Differential'
EXIT 1

Procedure PR_SHUTDOWN
'  Pressure Transfer -- This procedure performs a routine stop of the fill'
'                       when the liquid cylinder is full.'
external: ANALOUT, BEEP, DIGOUT, FCV68, FULL, PR_STAGE, RESP$, XCV28
 10 DIGOUT(XCV28,0) : 'Closes Solenoid Fill Valve #28'
 20 ANALOUT(FCV68,0) : 'Closes Flow Control Valve #68 To Prevent Venting Until Operator Disconnects Cylinder'
 30 BEEP : DIGOUT(FULL,1) : 'Beeps Operator For Completion And Lights Full Light'
 40 print"Liquid Cylinder Is Full.  Close Cylinder Manual Valves,"
 50 input"Disconnect, And Type '1' To Acknowledge ...";RESP$
 60 if val(RESP$)<>1 goto 40 else clear(RESP$)
 70 DIGOUT(FULL,0) : PR_STAGE=0 : EXIT
EXIT 1

Procedure PRESSURE
'  This procedure calls the appropriate routines for doing a'
'  pressure differential transfer for liquid cylinder filling.'
external: PR_STAGE, PR_FASTCOOL, PR_SLOWCOOL, PR_OPTIMUM, PR_FILL, PR_SHUTDOWN
 10 if PR_STAGE=0 EXIT
 20 on PR_STAGE goto 100, 200, 300, 400, 500
100 PR_FASTCOOL : goto 10
200 PR_SLOWCOOL : goto 10
300 PR_OPTIMUM : goto 10
400 PR_FILL : goto 10
500 PR_SHUTDOWN : goto 10
EXIT 1

Procedure PU_FASTCOOL
'  Pumped Transfer -- This procedure peforms a fast pump cooldown'
'                     if requested or continues slow cooldown if not'
'                     requested.'
real: LIQ_T_CALC, PUMP_T_INIT, START_TIME
external: ALARM, ANALIN, ANALOUT, DIGOUT, BEENUM, FCV68, PT20, PU_STAGE
external: RESP$, TC40, XCV28
 10 input"Do You Want A Fast Pump Cooldown (Y/N) ?"; RESP$
 20 if (RESP$<>"Y" or RESP$<>"N") goto 10
 30 if RESP$="Y" clear(RESP$) : goto 100 else clear(RESP$) : PU_STAGE=2 : EXIT
100 ANALOUT(FCV68,100) : 'Set Flow Control Valve #68 To 100% Open'
110 PUMP_T_INIT=ANALIN(TC40) : 'Store Initial Temperature Of Liquid Pump'
120 LIQ_T_CALC=-1248.1/(log(ANALIN(PT20))-11.664) : 'Calculates Liquid N2 Temperature At Tank Pressure In Deg R'
130 DIGOUT(XCV28,1) : 'Open Solenoid Fill Valve #28'
140 START_TIME=timer
150 if (ANALIN(TC40)<PUMP_T_INIT-20) goto 200 : 'Checks If Cooldown Started'
160 if (timer-START_TIME)>30 BEENUM=5 : ALARM else goto 150
200 if (ANALIN(TC40)<LIQ_T_CALC+10) goto 300 : 'Checks If Cooldown Reached'
```

```
210 if (timer-START_TIME)>300 ERRNUM=6 : ALARM else goto 200
300 wait(60) : 'Maintains Pump Cooldown For 1 Minute Before Proceeding To Prevent Cavitation'
310 PU_STAGE=3 : EXIT
EXIT 1

Procedure PU_SLOWCOOL
'  Pumped Transfer -- This procedure performs a slow pump cooldown'
'                     by calculating the optimum differential pressure'
'                     for the initial conditions.'
real: CYL_P, DELTA_P_CALC, LIQ_T_CALC, P_ERR, PCT, PUMP_T_INIT, START_TIME
real: TANK_P_INIT
external: ALARM, ANALIN, ANALOUT, DIGOUT, ERRNUM, FCV86, PT20, PU_STAGE
external: TC40, XCV28
 10 PCT=50
 20 ANALOUT(FCV68,PCT) : 'Set Flow Control Valve #68 To 50% Open To Start'
 30 PUMP_T_INIT=ANALIN(TC40) : 'Store Initial Temperature Liquid Pump'
 40 TANK_P_INIT=ANALIN(PT20) : CYL_P=ANALIN(PT66) : 'Store Initial Tank And Cylinder Pressure'
 50 LIQ_T_CALC=-1248.1/(log(ANALIN(PT20))-11.664) : 'Calculates Liquid N2 Temperature At Tank Pressure In Deg R'
 60 DIGOUT(XCV28,1) : 'Open Solenoid Fill Valve #28'
 70 DELTA_P_CALC=0.16905+0.41357*CYL_P-0.0031905*CYL_P^2+9.6e-6*CYL_P^3 : 'Calculate Optimal Differential Pressure'
 80 P_ERR=(ANALIN(PT20)-CYL_P)-DELTA_P_CALC
 90 if ABS(P_ERR)<1 goto 200
100 PCT=PCT*(1+(P_ERR/DELTA_P_CALC))
110 ANALOUT(FCV68,PCT) : goto 80 : 'Set Flow Control Valve #68 To Calculated Percent'
200 START_TIME=timer
210 if (ANALIN(TC40)<PUMP_T_INIT-20) goto 300 : 'Checks If Cooldown Started'
220 if (timer-START_TIME)>60 ERRNUM=7 : ALARM else goto 210
300 if (ANALIN(TC40)<LIQ_T_CALC+10) goto 400 : 'Checks If Cooldown Reached'
310 if (timer-START_TIME)>300 ERRNUM=8 : ALARM else goto 300
400 wait(60) : 'Maintains Pump Cooldown For 1 Minute Before Proceeding To Prevent Cavitation'
410 PU_STAGE=3 : EXIT
EXIT 1

Procedure PU_OPTIMUM
'  Pumped Transfer -- This procedure is the main routine for calculating'
'                     the optimum differential filling pressure for'
'                     the cylinder filling sequence.'
real: CYL_P, DELTA_P_CALC, P_ERR, PCT, TANK_P
external: ANALIN, ANALOUT, FCV68, PU_STAGE, PT20, PT66
 10 TANK_P=ANALIN(PT20) : CYL_P=ANALIN(PT66) : 'Store Current Tank And Cylinder Pressure'
 20 DELTA_P_CALC=0.16905+0.41357*CYL_P-0.0031905*CYL_P^2+9.6e-6*CYL_P^3 : 'Calculate Optimal Differential Pressure'
 30 P_ERR=(ANALIN(PT20)-CYL_P)-DELTA_P_CALC
 40 if ABS(P_ERR)<1 goto 100
 50 PCT=PCT*(1+(P_ERR/DELTA_P_CALC))
 60 ANALOUT(FCV68,PCT) : goto 10 : 'Set Flow Control Valve #68 To Calculated Percent'
100 PU_STAGE=4 : EXIT
EXIT 1

Procedure PU_FILL
'  Pumped Transfer -- This procedure is the main shutdown routine for'
'                     checking for alarm conditions or for a full'
'                     signal from the scale.  The optimum differential'
'                     filling pressure is recalculated and adjusted'
'                     every time through the loop.'
byte: CAVIT_COUNT, ONCETHRU
real: LIQ_T_CALC, START_TIME
external: ALARM, ANALIN, DIGIN, DIGOUT, DPS48, ERRNUM, MS36, PU_STAGE, PT66
external: SCALE94, TC40
 10 if ONCETHRU goto 30
 20 START_TIME=timer : CAVIT_COUNT=1 : DIGOUT(MS36,1) : ONCETHRU=1 : wait(5) : 'Start Pump Motor Starter #36'
 30 LIQ_T_CALC=-1248.1/(log(ANALIN(PT66))-11.664) : 'Calculates Liquid N2 Temperature At Cylinder Pressure In Deg R'
 40 if (timer-START_TIME)>900 ERRNUM=9 : ONCETHRU=0 : ALARM : EXIT : 'Checks If Fill Takes Longer Than 20 Min.'
 50 if ANALIN(TC56)<LIQ_T_CALC+5 ERRNUM=10 : ONCETHRU=0 : ALARM : EXIT : 'Checks If Liquid Venting From Cylinder'
```

```
 60 if DIGIN(DPS48)=0 BERNUM=11 : gosub 100 : 'Checks If Pump Cavitating'
 70 if ANALIN(TC40)>LIQ_T_CALC+5 BERNUM=12 : gosub 100 : 'Checks If Pump Temperature Warming - Backup Cavitation Check'
 80 if DIGIN(SCALE94) PU_STAGE=5 : ONCETHRU=0 : EXIT : 'Proceeds To Shutdown Fill When Cylinder Full'
 90 PU_STAGE=3 : EXIT : 'Fill Proceeding Fine So Readjust Optimum Pressure Differential'
100 if CAVIT_COUNT>3 ONCETHRU=0 : ALARM : EXIT : 'Alarms On Maximum Cavitation Count'
110 DIGOUT(MS36,0) : wait(30) : DIGOUT(MS36,1) : 'Continue Cooldown For 30 Seconds Before Restarting Pump'
120 CAVIT_COUNT=CAVIT_COUNT+1 : goto 30 : 'Increment Cavitiation Count'
EXIT 1

Procedure PU_SHUTDOWN
'  Pumped Transfer -- This procedure performs a routine stop of the fill'
'                     when the liquid cylinder is full.'
external: ANALOUT, BEEP, DIGOUT, FCV68, FULL, MS36, PU_STAGE, RESP$, XCV28
 10 DIGOUT(MS36,0) : 'Deactivates Liquid Pump Motor Starter #36'
 20 DIGOUT(XCV28,0) : 'Closes Solenoid Fill Valve #28'
 30 ANALOUT(FCV68,0) : 'Closes Flow Control Valve #68 To Prevent Venting Until Operator Disconnects Cylinder'
 40 BEEP : DIGOUT(FULL,1) : 'Beeps Operator For Completion And Lights Full Light'
 50 print"Liquid Cylinder Is Full.  Close Cylinder Manual Valves,"
 60 input"Disconnect, And Type '1' To Acknowledge ...";RESP$
 70 if val(RESP$)<>1 goto 40 else clear(RESP$)
 80 DIGOUT(FULL,0) : PU_STAGE=0 : EXIT
EXIT 1

Procedure PUMPED
'  This procedure calls the appropriate routines for doing a'
'  pumped transfer for liquid cylinder filling.'
external: PU_STAGE, PU_FASTCOOL, PU_SLOWCOOL, PU_OPTIMUM, PU_FILL, PU_SHUTDOWN
 10 if PU_STAGE=0 EXIT
 20 on PU_STAGE goto 100, 200, 300, 400, 500
100 PU_FASTCOOL : goto 10
200 PU_SLOWCOOL : goto 10
300 PU_OPTIMUM : goto 10
400 PU_FILL : goto 10
500 PU_SHUTDOWN : goto 10
EXIT 1

'  This is the main routine for initializing an automated liquid'
'  cylinder fill.  It identifies between a pressure differential'
'  and pumped transfer fill.'
 10 for i=1 to 4 : atype(i,0,0,1,5,4,0) : next i : 'Initialize Analog Input Channels'
 20 atype(5,0,0,1,5,0,0) : 'Initialize Analog Output Channel'
 30 for i=1 to 2 : dtype(i,0,0,0,0,0) : next i : 'Initialize Digital Input Channels'
 40 for i=9 to 13 : dtype(i,0,0,1,1,0) : next i : 'Initialize Digital Output Channels'
 50 PT20=1 : TC40=2 : TC56=3 : PT56=4 : FCV68=5 : 'Set Analog Channel Labels'
 60 SCALE94=1 : DPS48=2 : XCV28=9 : MS36=10 : HORN=11 : FULL=12 : BRELITE=13 : 'Set Digital Channel Labels'
100 print"Attach Liquid Cylinder, Fully Open Cylinder Manual Valves,"
110 print"Tare Cylinder Weight, And Enter Full Liquid Weight On Scale."
120 input"Type '1' To Acknowledge When Finished ...";RESP$ : print
130 if val(RESP$)<>1 goto 100 else clear(RESP$)
140 print"Enter Number For Type Fill:  '1' -- Pressure Transfer"
150 input"                            '2' -- Pumped Transfer ...";RESP$
160 if val(RESP$)=1 clear(RESP$) : PR_STAGE=1 : PRESSURE : goto 100
170 if val(RESP$)=2 clear(RESP$) : PU_STAGE=1 : PUMPED : goto 100
180 clear(RESP$) : goto 140

ENDFILE
```

©Air Products and Chemicals, Inc.

I claim:

1. A method for minimizing cryogenic substance loss in a filling station having a storage tank storing cryogenic substance for loading a container having an outlet vent with a throttle vent valve for adjusting the differential pressure between the substance being loaded and the container, comprising the steps of:

(a) first determining a value of filling loss for each of a plurality of values of differential pressure;

(b) selecting and storing prior to loading an optimum value of differential pressure from the plurality of values to produce the minimum filling loss;

(c) loading substance into a container;

(d) continuously monitoring the differential pressure during loading;

(e) comparing the monitored differential pressure to the optimum differential pressure;

(f) adjusting the throttle vent valve to maintain the monitored differential pressure at a value substantially equal to the optimum differential pressure value;

(g) selecting at least one new optimum value of differential pressure during loading of the container;

(h) adjusting the throttle vent valve to bring the differential pressure to a value substantially equal to the new optimum differential pressure value during loading of the container; and (i) repeating steps (g) and (h) until the filling process is terminated.

2. The method of claim 1 in which the station is provided with a fill valve for controlling the flow of substance from the storage tank to the container and step (c) is preceded by the steps of:

opening the fill valve for permitting substance to flow from the storage tank to the container thereby cooling the container;

sensing the temperature substantially near the outlet vent of the container;

determining whether the temperature has reached a predetermined level; and adjusting the throttle vent valve in response to the temperature determination for providing container cool down prior to adjusting the throttle vent valve.

3. The method of claim 1 further comprising the steps of:

sensing the weight of the substance loaded into the container;

determining when a predetermined weight of substance is loaded into the container; and controlling the fill valve for terminating the supply of substance to the container in response to the weight determination.

4. The method of claim 1 further comprising the steps of:

sensing the temperature substantially near the outlet vent of the cylinder;

determining whether the temperature has reached a predetermined level; and controlling the fill valve in response to the outlet vent temperature to terminate the supply of substance to the container for preventing substance from overflowing from the container.

5. The method of claim 1 in which the station is provided with a pump for transferring substance from the storage tank to the container further comprising:

(a) supplying substance to the pump;

(b) sensing the pump temperature;

(c) determining when the sensed temperature has reached a predetermined level; and {(d) controlling the pump motor in response to the determination.

6. The method of claim 1 in which the station is provided with a pump for transferring substance from the storage tank to the container, further comprising:

sensing the differential pressure across the inlet and outlet of the pump during motor operation;

controlling the pump motor in accordance with the sensed differential pressure.

7. A method for minimizing substance loss in a filling station having a storage tank storing cryogenic substance for loading a container having an outlet vent with a throttle vent valve for adjusting the differential pressure between the substance being loaded and the container, the station having a fill valve for controlling the flow of substance from the storage tank to the container, comprising the steps of:

(a) selecting an optimum differential pressure;

(b) loading substance into the container, thereby cooling the container;

(c) monitoring the differential pressure during loading;

(d) sensing the temperature substantially near the outlet vent of the container;

(e) determining whether the temperature has reached a predetermined level; and (f) adjusting the throttle vent valve to bring the monitored differential pressure to a value substantially equal to the optimum differential pressure in response to the temperature determination for providing container cool down prior to adjusting the throttle vent valve;

(g) selecting at least one new optimum value of differential pressure during loading of the container;

(h) adjusting the throttle vent valve to bring the differential pressure to a value substantially equal to the new optimum differential pressure value during loading of the container; and (i) repeating steps (g) and (h) until the filling process is terminated.

8. The method of claim 7 further comprising the steps of:

sensing the weight of the substance loaded into the container;

determining when a predetermined weight of substance is loaded into the container; and controlling the fill valve for terminating the supply of substance to the container in response to the weight determination.

9. The method of claim 7 further comprising the step of:

controlling the fill valve in response to the outlet vent temperature to terminate the supply of substance to the container for preventing substance from overflowing from the container.

* * * * *